US005583534A

United States Patent [19]

Katakura et al.

[11] Patent Number: 5,583,534

[45] Date of Patent: Dec. 10, 1996

[54] METHOD AND APPARATUS FOR DRIVING LIQUID CRYSTAL DISPLAY HAVING MEMORY EFFECT

[75] Inventors: Kazunori Katakura; Akira Tsuboyama, both of Atsugi, Japan

[73] Assignee: Canon Kabushiki Kaisha, Tokyo, Japan

[21] Appl. No.: 197,319

[22] Filed: Feb. 16, 1994

[30] Foreign Application Priority Data

Feb. 18, 1993 [JP] Japan ..... 5-051227
Jan. 13, 1994 [JP] Japan ..... 6-014097

[51] Int. Cl.[6] ..... G09G 3/36

[52] U.S. Cl. ..... 345/97; 345/87; 348/792

[58] Field of Search ..... 345/98, 87, 94, 345/87, 95, 97, 88; 348/790, 792, 793; 359/54, 55, 56

[56] References Cited

U.S. PATENT DOCUMENTS

| | | | |
|---|---|---|---|
| 4,870,396 | 9/1989 | Shields | 359/55 |
| 4,902,107 | 2/1990 | Tsuboyama et al. | 359/55 |
| 5,006,839 | 4/1991 | Fujita | 345/95 |
| 5,026,144 | 6/1991 | Taniguchi et al. | 350/350 S |
| 5,041,821 | 8/1991 | Onitsuka et al. | 340/784 |
| 5,091,723 | 2/1992 | Kanno et al. | 345/94 |
| 5,168,270 | 12/1992 | Masumori et al. | 348/790 |
| 5,289,173 | 2/1994 | Numao | 345/87 |
| 5,374,941 | 12/1994 | Yuki et al. | 345/95 |

FOREIGN PATENT DOCUMENTS

| | | |
|---|---|---|
| 63-65494 | 3/1988 | Japan . |
| 2-131286 | 5/1990 | Japan . |
| 5-27716 | 2/1993 | Japan . |

*Primary Examiner*—Kee Mei Tung
*Assistant Examiner*—Doon Chow
*Attorney, Agent, or Firm*—Fitzpatrick, Cella, Harper & Scinto

[57] ABSTRACT

There are method and apparatus for driving a liquid crystal display apparatus which has a liquid crystal and electrodes arranged in a matrix form and in which a number of pixels having a memory effect are provided. Image information is displayed by a refresh scanning by using the liquid crystal display apparatus and is displayed by a non-refresh scanning without substantially changing the image information displayed by the liquid crystal display apparatus. A signal to fluctuate a transmission light amount of the pixel is applied to the electrode during the execution of the display by the non-refresh scanning. A smectic liquid crystal or a ferroelectric liquid crystal is used as a liquid crystal.

26 Claims, 16 Drawing Sheets

METHOD AND APPARATUS FOR DRIVING LIQUID CRYSTAL DISPLAY HAVING MEMORY EFFECT

BACKGROUND OF THE INVENTION

1. Field of the Invention

The invention relates to a display apparatus such as television receiver, view finder of a video camera, monitor for a terminal of a computer, or the like or to a display apparatus such as a projector having a light valve or the like. More particularly, the invention relates to method and apparatus for driving a liquid crystal display apparatus in which a liquid crystal has a memory performance in a liquid crystal device in which scanning signal lines and information signal lines are arranged in a matrix form and which is used to display video information by being driven by applying a scanning signal and an information signal to those signal lines, respectively.

2. Related Background Art

Hitherto, a refresh scanning type CRT is mainly used as a computer terminal display apparatus. A frame frequency of 60 Hz or higher is used to prevent the flickering of the screen. A non-interlace system is also used to improve the visibility of the moving display (movement using a mouse, an icon, or the like) of information in the screen. Therefore, as a display resolution rises, a high power is required and the size and costs of a drive control section also increase. In the television receiver, the interlace system is used, a field frequency is set to 60 Hz, and a frame frequency is set to 30 Hz for the purpose of convenience of the moving image display and simplicity of a drive control system.

In recent years, a flat panel display is highlighted because of inconvenience of the large size and high power of the CRT.

At present, there are several systems as a flat panel display. For example, there are a high time division system of a twisted nematic liquid crystal (STN), a system for a black and white display (NTN) as a modification of the STN, a plasma display system, and the like. All of those systems use the same system as that of the CRT as an image data transfer system. As a screen updating system, the non-interlace system having a frame frequency of 60 Hz is used. This is because since those display panels don't have a memory performance in terms of the display principle, a refresh cycle of a frequency that is equal to or higher than the frame frequency of 60 Hz or higher is needed to prevent the flickering. Even in a system (TFT, MIM, TFD, etc.) such that a switching transistor or a non-linear device is formed in each pixel of the twisted nematic liquid crystal, image information can be held within up to one frame. Therefore, a refresh cycle of 60 Hz or more is also necessary in a manner similar to each of the above systems.

On the other hand, since a display apparatus using a ferroelectric liquid crystal has a feature (memory performance) such that the image information which was once displayed can be held, a fairly larger screen and higher fineness than those of the above various kinds of display apparatuses can be realized. Since such a ferroelectric liquid crystal display apparatus is driven by a low frame frequency, however, in order to cope with the man-machine interface type display apparatus, a partial rewriting scanning (only the scanning line in which the image information was changed is scanned (driven)) system using the memory performance is necessary. With respect to such a partial rewriting scanning system, for instance, trials to realize it have been being made by the method of "low frame frequency driving (multi-interlace scanning) +partial rewriting scanning" to perform a display at a high resolution in a display apparatus having the memory performance which has been disclosed in Japanese Patent Laid-Open Application No. 63-285141, Japanese Patent Laid-Open Application No. 63-65494, or the like proposed by the present inventors et al. on the basis of the system proposed in the Official Gazette of U.S. Pat. No. 4,655,561 by Kamibe et. al.

In Japanese Patent Laid-Open Application No. 5-27716 or the like, there is disclosed the method of "Memory display" such that in the case where there is a change in image information, a partial rewriting is executed and, in the case where there is no change, no voltage is applied to a liquid crystal display device. By such a method, an electric power consumption is reduced and a durability is improved.

In the drive control method of the liquid crystal display device so far, as mentioned above, when there is a change in image information, the partial rewriting scanning is executed and, when there is no change, either one of the following processes is executed.

(1) The whole screen refresh scanning by the multi-interlace or the like is continued.

(2) The apply of the signal is stopped and the memory display is performed.

In the whole screen refresh scanning of (1), however, there is a case where when the same image is displayed for a long time, a picture quality deteriorates. In the memory display system of (2) which can improve such a drawback, since contrasts upon driving and upon memory display are different, there is a case where a flickering occurs when the driving means is switched.

SUMMARY OF THE INVENTION

It is the first object of the invention to solve the above technical problems and to provide an apparatus for displaying in which a fluctuation of a contrast is suppressed and a picture quality is hardly deteriorated.

The second object of the invention is to provide a method of driving a display apparatus, comprising the steps of: displaying by a refresh scanning on the basis of image information by using a liquid crystal display apparatus which has a liquid crystal and electrodes arranged in a matrix form and in which a number of pixels having a memory effect are provided; and displaying by a non-refresh scanning without substantially changing the image information displayed in the liquid crystal display apparatus, wherein a signal to fluctuate a transmission light amount of the pixel is applied to the electrode during the step of displaying by the non-refresh scanning.

The third object of the invention is to provide an apparatus for driving a display apparatus, comprising: refresh scanning means for refresh scanning to display image information by using a liquid crystal display apparatus which has a liquid crystal and electrodes arranged in a matrix form and in which a number of pixels having a memory effect are provided; and non-refresh scanning means for non-refresh scanning to display without substantially changing the image information displayed in the liquid crystal display apparatus, wherein a signal to fluctuate a transmission light amount of the pixel is applied to the electrode during the non-refresh scanning operation.

The fourth object of the invention is to provide an apparatus for driving and controlling a liquid crystal display apparatus comprising: liquid crystal display means which has a liquid crystal and electrodes arranged in a matrix form and in which a number of pixels having a memory effect are provided; and scanning means for scanning the pixels in order to display image information by using the display means, wherein the apparatus has selecting means for selecting either one of a refresh scanning mode for refresh scanning in order to display the image information by using the liquid crystal display apparatus and a non-refresh scanning mode for non-refresh scanning in order to display the image information without substantially changing the image information displayed in the liquid crystal display apparatus, and in the non-refresh scanning mode, the scanning means is controlled so as to allow a signal to fluctuate a transmission light amount of the pixel to be supplied from the scanning means to a plurality of information electrodes.

The fifth object of the invention is to provide an apparatus for displaying, comprising: liquid crystal display means which has a liquid crystal and electrodes arranged in a matrix form and in which a number of pixels having a memory effect are provided; scanning means for scanning the display means in order to display image information; and selecting means for selecting either one of a refresh scanning mode for refresh scanning in order to display the image information and a non-refresh scanning mode for non-refresh scanning in order to display the image information without substantially changing the image information displayed in the liquid crystal display means, wherein in the non-refresh scanning mode, the scanning means is controlled for allowing a signal to fluctuate a transmission light amount of the pixel to be supplied from the scanning means to a plurality of information electrodes.

The sixth object of the invention is to provide an apparatus comprising: a liquid crystal display panel which constructs pixels in a matrix form by a group of scanning electrodes and a group of information electrodes; a liquid crystal which is arranged in the liquid crystal display panel and is driven by an electric field which is applied through the group of scanning electrodes and the group of information electrodes; image information memory means for storing image information to be displayed by the liquid crystal display panel; change detecting means for detecting a change in image information stored in the image information memory means; first driving means for applying a scanning signal to the group of scanning electrodes and applying an information signal to the group of information electrodes on the basis of the image information stored in the image information memory means; and second driving means for applying a waveform which gives a luminance similar to that in a scanning non-selection period by the first driving means to the liquid crystal display panel while holding the display on the display panel through the group of scanning electrodes and the group of information electrodes in accordance with the result of the detection by the change detecting means.

The seventh object of the invention is to provide an apparatus comprising: a liquid crystal display panel which constructs pixels in a matrix form by a group of scanning electrodes and a group of information electrodes; a liquid crystal which is arranged in the liquid crystal display panel and is driven by an electric field which is applied through the group of scanning electrodes and the group of information electrodes; image information memory means for storing image information to be displayed by the liquid crystal display panel; change detecting means for detecting a change in image information stored in the image information memory means; driving means for applying a scanning signal to the group of scanning electrodes and applying an information signal to the group of information electrodes on the basis of the image information stored in the image information memory means; memory display means for holding the display on the liquid crystal display panel without applying a voltage to the liquid crystal; and drive control means for switching a display mode of the liquid crystal to a normal display state by the driving means or a memory display state by the memory display means in accordance with the result of the detection by the change detecting means, wherein a predetermined switching period is provided when switching between the normal display state and the memory display state.

DETAILED DESCRIPTION OF THE PREFERRED EMBODIMENTS

Embodiments of the present invention will now be described hereinbelow. However, the invention can be also applied to any means which can accomplish the objects of the present invention and various component elements of the invention can be also substituted to alternatives or equivalent objects.

Figure 1:
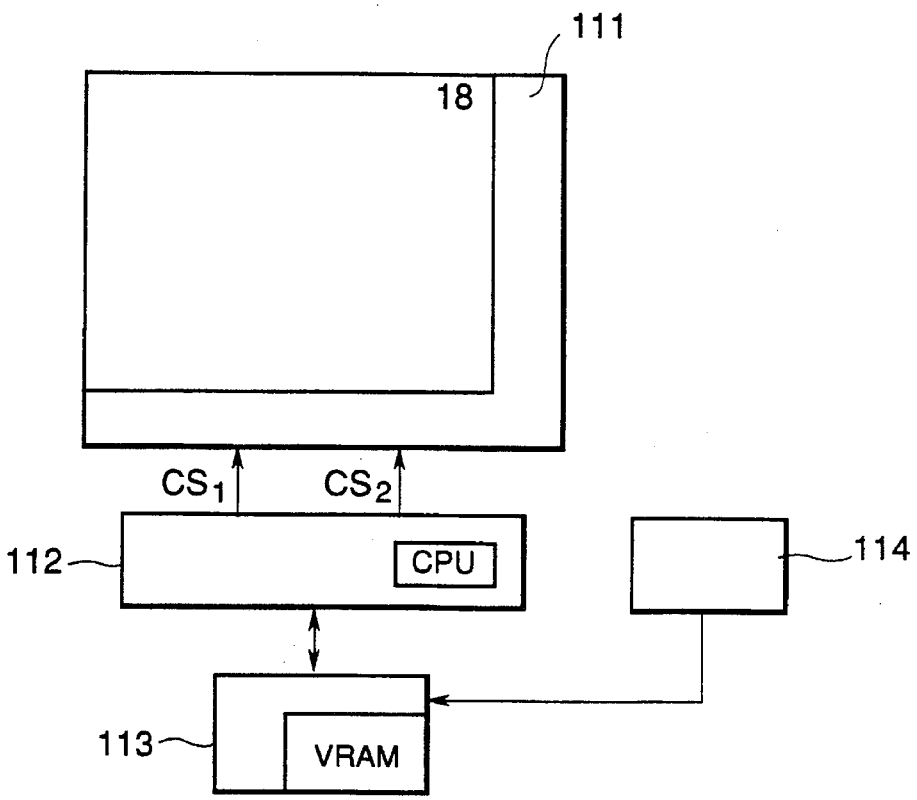
FIG. 1 is a block diagram of a display apparatus according to an embodiment of the present invention.

FIG. 1 is a block diagram of a display apparatus according to the invention.

Reference numeral 18 denotes a liquid crystal display panel which includes a liquid crystal as a display device and matrix electrodes and has a number of pixels.

Reference numeral 111 denotes a driving apparatus for the display panel 18 and includes a scanning circuit which can selectively execute a refresh scanning and a non-refresh scanning.

Reference numeral 112 denotes a control apparatus for the driving apparatus 111 and selectively supplies two signals $CS_1$ and $CS_2$ to the driving apparatus 111 in order to select either one of a mode to perform the refresh scanning and a mode to perform the non-refresh scanning under control of a CPU.

Reference numeral 113 denotes a circuit to generate a signal serving as a reference to select the above modes. The circuit 113 has a memory (VRAM) to store image information to be displayed and detects whether there is a change in storage information or not and supplies a detection signal to the CPU.

Reference numeral 114 denotes a signal source to generate image information to be displayed. The signal source 114 includes an image sensor, a computer to execute an application program, and the like.

Figure 2:
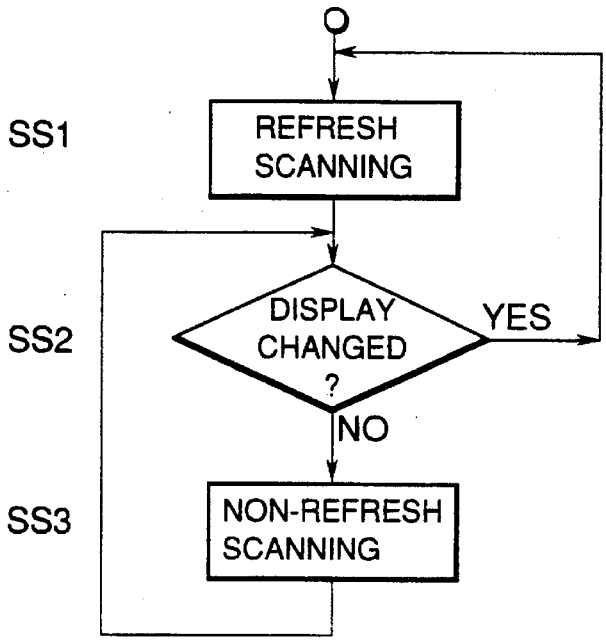
FIG. 2 is a flowchart for explaining a driving control method according to the invention.

FIG. 2 is a flowchart for explaining a driving control method of the display apparatus according to the invention.

In the case where the display is executed by the refresh scanning, for example, every frame, a check is made to see if there is a change in information to be displayed or not (step SS2).

If there is a change, the processing routine is returned to step SS1, the refresh scanning is performed, and new image information is displayed.

If there is no change, step SS3 follows and the displayed image is held by using a memory effect of the pixel without substantially changing. In the invention, the signal is supplied to the matrix electrodes in step SS3, thereby slightly changing a state of a liquid crystal molecule of the pixel. Namely, by applying an electric field to the liquid crystal of the pixel, a transmission factor of the pixel changes. However, a pulse width, an amplitude, a frequency, and the like of the signal which is applied are previously selected and designed in a manner such that the display state is not substantially changed even by a change in transmission factor. Specifically speaking, in case of a ferroelectric liquid crystal, a signal such that the molecule fluctuates although an orientation state of the liquid crystal molecule which is in one of the bistable states is not changed is given.

In case of the pixel having a memory effect by an active matrix, a signal such that, after a potential of a common electrode was slightly fluctuated, it is returned to an original state is given.

Although the above sequence has been mentioned on the assumption of changes in display states of all of the pixels as a prerequisite, it can be also executed by paying an attention to the display state of a part of the screen.

In the conventional driving method, since no electric field is applied to the pixels in case of step SS3, differences between the contrast and luminance in the refresh scanning mode in step SS1 and the contrast and luminance in case of the non-refresh scanning mode in step SS3 are too large, so that a flickering due to a change in mode is conspicuous on the display screen. On the other hand, according to the invention, by applying the above signal, such differences can be reduced.

As a liquid crystal which is used in the invention, a smectic liquid crystal showing ferroelectricity in case of a simple matrix type and a nematic liquid crystal in case of an active matrix type are used.

In order to prevent a fluctuation in cell thickness, it is desirable to select a liquid crystal material and an orientation film in a manner such that a pretilt angle as an angle between a pair of substrate inner surfaces which sandwich the liquid crystal and the liquid crystal molecule is as small as possible such that it is equal to or less than 20°, more preferably, 15° or less, and optimally, 5° or less.

EMBODIMENT 1

In the embodiment 1, an image display according to image information which changes momentarily is ordinarily executed by the partial rewriting scanning or the whole screen refresh scanning by the multi-interlace or the like. However, in the case where it is judged that the image information is not changed for a predetermined period of time from the result of the detection by change detecting means or the like, driving control means applies a signal waveform which gives a luminance similar to that in the ordinary driving state while holding the display on the display panel. After that, in the case where the change detecting means detects a change in image information or the like, the driving control means restarts to apply a scanning signal and an information signal, so that the ordinary display is again performed. Consequently, the same display period which becomes a cause of deterioration in picture quality is reduced, the deterioration of the picture quality is prevented, and the reliability of the apparatus is raised. An electric power consumption can be further reduced without causing a flickering upon switching of the driving means.

Figure 3:
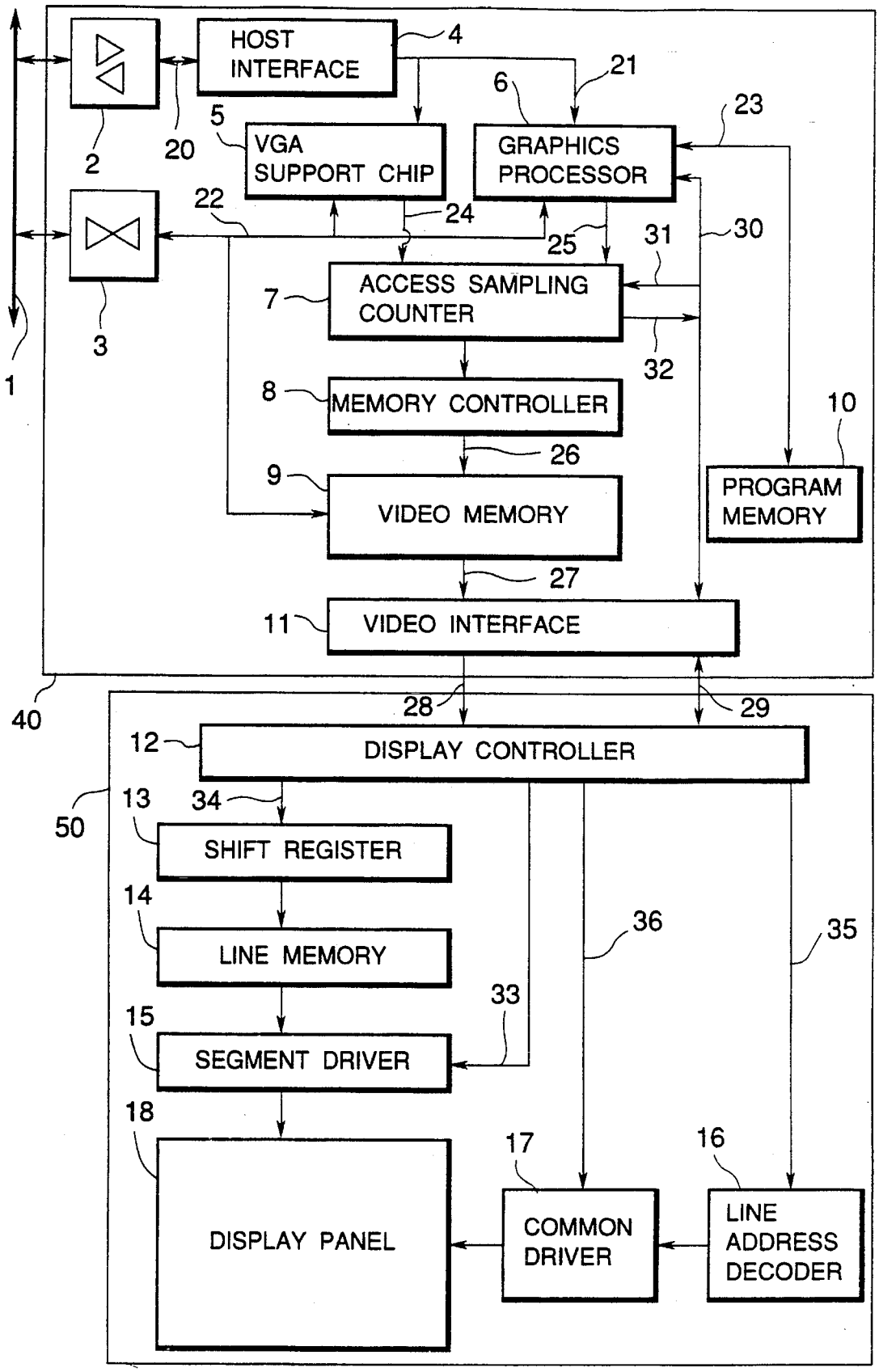
FIG. 3 is a block diagram of a display apparatus according to an embodiment of the invention.

FIG. 3 is a block diagram showing a construction of a display apparatus according to the embodiment 1 of the invention. In the diagram, reference numeral 1 denotes a system bus; 40 an FLC display unit; and 50 a control circuit of the FLC display unit 50. In the control circuit 40, reference numeral 2 denotes a driver of an address signal, an access request signal, a response signal, and the like; 3 a data buffer; 4 a host interface as an interface circuit with a host CPU and a processor in the control circuit; 5 an exclusive-use LSI to support a register of a VGA or the like; 6 a graphics processor to execute a drawing and a data transfer; 9 a video memory to store display information; 7 an access sampling counter which is reset by the access signal to the video memory 9; 8 a memory controller to generate a control signal to the video memory 9; 10 a program memory which is constructed by a dynamic RAM or the like to store a program for the graphics processor 6; and 11 a video interface to transmit and receive video data, a sync signal, and the like to/from the FLC display unit 50.

Further, reference numeral 20 denotes an address signal, an access request signal, a response signal, and the like; 21 an access signal to the VGA support chip 5 and graphics processor 6; 23 data which is transmitted and received between the graphics processor 6 and the program memory 10; 22 data which is transmitted and received between the data buffer 3 and the VGA support chip 5, graphics processor 6, and video memory 9; 24 an access request from the VGA support chip 5 to the video memory 9 for the memory controller 8; 25 an access request from the graphics processor 6 to the video memory 9 for the memory controller 8; 26 a control signal to the video memory 9; 27 display data which was read out from the video memory 9; 28 data which is sent to the FLC display unit 50; 29 a sync signal and a control signal which are transmitted and received between the FLC display control circuit 40 and the FLC display unit 50; 30 a sync signal and a control signal; 31 a sync signal which is input to the access sampling counter 7; and 32 a notification signal indicating that there is no access to the video memory for a predetermined time or more.

In the FLC display unit 50, reference numeral 12 denotes a display controller to perform controls of the whole display unit 50 such as interface with the display control circuit 40, control of both of a segment driver and a common driver, and the like; 13 a shift register to transfer video data 34 from the display controller 12 by an amount corresponding to one line; 14 a line memory to store the video data of one line; 15 a segment driver to generate a predetermined driving waveform at a predetermined timing to the information electrodes of the display panel 18 in accordance with the video data stored in the line memory 14; 18 the display panel using a ferroelectric liquid crystal; 16 a line address decoder to select one of the scanning lines in accordance with scanning line address data 35 from the display controller 12; 17 a common driver to generate a predetermined driving waveform at a predetermined timing to the selected scanning line (scanning electrode); and 33 and 36 respectively control lines to the segment driver and to common driver. It is considered that the driving apparatus 111 in FIG. 1 correspond to the drivers 15 and 17 and the control apparatus 112 corresponds to the controller 12 and the circuit 113 corresponds to the FLC display control circuit 40, respectively.

The fundamental operation of the screen display in the apparatus of FIG. 3 will now be described. First, a case where the host CPU updates the display screen, namely, a case where the operator executes the ordinary operation will now be described.

In a general CRT control circuit, the host CPU can directly access the video memory at random. In the FLC display control circuit 40 in the embodiment, however, the host CPU cannot directly access the video memory 9 at random but the host CPU executes the rewriting operation or the like of the display data through the graphics processor 6. For example, in a case such that a straight line is displayed, the host CPU generates a straight line drawing command to the graphics processor 6 and gives necessary information such as start point, end point, and the like. The graphics processor 6 decides an access address or the like in accordance with the given information and accesses the video memory 9. In case of a command regarding the display of another figure, character, or the like or the VGA as well, it is similarly executed by accessing the video memory 9 by the graphics processor 6 or VGA support chip 5 in response to a command from the host CPU (in case of the VGA, as a BIOS command).

The access sampling counter 7 monitors an accessing state to the video memory 9. When the access (writing) to the video memory 9 is not executed for a predetermined time or more, the access sampling counter 7 outputs the notification signal 32 indicative of such a fact to the FLC display unit 50. When the graphics processor 6 or VGA support chip 5 accesses to the video memory 9, the access sampling counter 7 is reset and restarts the counting operation from the beginning. In the case where the operator executes the ordinary operation, the access to the video memory 9 is continuously executed, so that the notification signal 32 is not generated from the access sampling counter 7.

The display data in the video memory 9 is sequentially read out from the video memory 9 one line by one in response to an instruction from the graphics processor 6 and is supplied to the FLC display unit 50 through the video interface 11 together with scanning line address data (not shown on the control circuit side in FIG. 3). In this instance, a drawing event is judged by either one of a method whereby the graphics processor 6 discriminates whether the input data is the data which requires a high response speed, namely, the image information which needs the partial rewriting operation or not from the given drawing command and a method whereby the host CPU gives discrimination information regarding whether the input data is the data which needs the partial rewriting operation or not to the graphics processor 6. The display data which requires a high response speed of the display for the FLC display is preferentially transferred. The display controller 12 in the FLC display unit 50 receives the scanning line address data and display data (video data) from the FLC display control circuit 40. The scanning address data 35 is transferred to the line address decoder 16 of the scanning electrode driving circuit (16, 17). The video data 34 is transferred to the shift register 13 of the information electrode driving circuit (13 to 15).

The line address decoder 16 of the scanning electrode driving circuit selects one of the scanning lines on the basis of the scanning line address data 35. The common driver 17 outputs a predetermined driving waveform to the selected scanning line (scanning electrode) for a selection period of time (one horizontal scanning period). On the other hand, after completion of the shifting operation of the video data of one line, the shift register 13 of the information electrode driving circuit transfers the video data to the line memory 14 and holds for one horizontal scanning period. The segment driver 15 outputs a driving waveform according to the video data in the line memory 14 synchronously with the selection period of the common driver 17. As mentioned above, the writing operation to the display panel in the ordinary operating mode is executed by the line sequential scanning which is generally well-known. In this instance, the partial rewriting scanning is executed with respect to the drawing information in which a high response speed is particularly required as a man-machine interface such as cursor movement, character input, screen scroll, or the like. The whole screen refresh scanning by the multi-interlace or the like is performed with regard to the other drawing information.

The case where the host CPU doesn't execute the updating operation of the display screen for a predetermined time or more will now be described. In this case, the driving signal to the panel 18 is changed so as to set the FLC display panel is set into the memory state without causing a flickering in the display contents on the display screen by the notification signal 32 from the access sampling counter 7.

The access sampling counter 7 is a counter such that the access (writing-in) signal to the video memory 9 is used as a reset (or preset) signal and the sync signal 31 (for example, horizontal sync signal) from the FLC display unit 50 is used as a clock. An overflow (carry) signal of the counter is used as a notification signal 32 indicating that the video memory 9 is not accessed for a predetermined time or more. Actually, one frame time (for example, horizontal sync signal ×1024 assuming that the number of scanning lines is equal to 1024) is counted from the sync signal 31 (horizontal sync signal). The signal which is obtained by frequency dividing the one frame time into 1/64 is used as a clock and input to an 8-bit counter (access sampling counter). Now assuming that a standard horizontal scanning time of the FLC display panel is equal to 100 μsec, a detecting time can be set to a value within a range from about six seconds to about 27 minutes in accordance with the preset value of the counter. When the video memory 9 is not accessed for such a set detecting time, the access sampling counter 7 asserts the notification signal 32 (sets into an enable state), thereby informing the display controller 12 of the fact that the access to the video memory 9 has been stopped (there is no change in the screen display). The notification signal 32 is output asynchronously with the driving of the display panel 18.

When the display controller 12 recognizes that the notification signal 32 was asserted, it waits for the end of driving of the scanning electrode which is at present being scanned (since the notification signal 32 is asynchronously received) and sends a driving waveform change signal (included in the signals 33 and 36) to both of the segment driver and the common driver. For this period of time, the scanning signal is held to a voltage level Vc shown in (c) in FIG. 4. That is, after completion of the scanning, all of the bits of the segment driver 15 output a waveform shown in (d) in FIG. 4 for a predetermined period of time, thereby holding the luminance.

The operation when returning from the memory state by the non-refresh scanning to the ordinary driving state will now be described. When the access to the video memory 9 is executed even at once, the sampling counter 7 immediately negates the notification signal 32 (sets into a disable state), thereby informing the display controller 12 of the fact that there is an access (writing request) to the video memory 9. Since the notification signal 32 in this instance is output asynchronously with the driving (scanning) of the display panel 18 in a manner similar to the case of the asserting operation, the display controller 12 waits for the end of the driving of the scanning electrode which is at present being scanned (synchronously with the scanning of the display panel) and negates the driving waveform change signals 33 and 36 to both of the segment and common drivers, thereby returning to the ordinary driving state, namely, the above-mentioned "partial rewriting scanning+whole screen refresh scanning" state.

Figure 4:
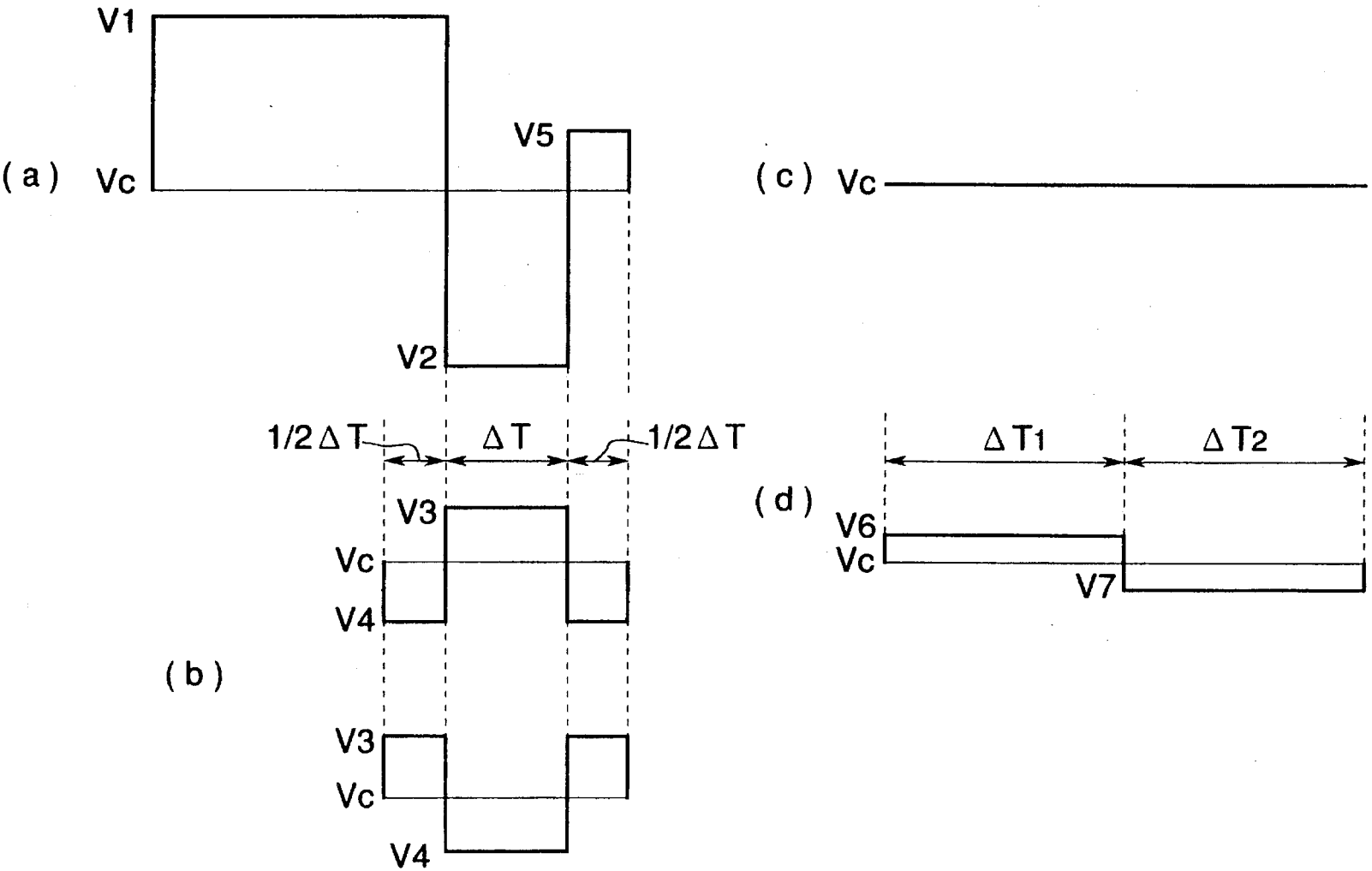
FIG. 4 is a diagram showing driving waveforms used in the apparatus of FIG. 3.
Figure 5:
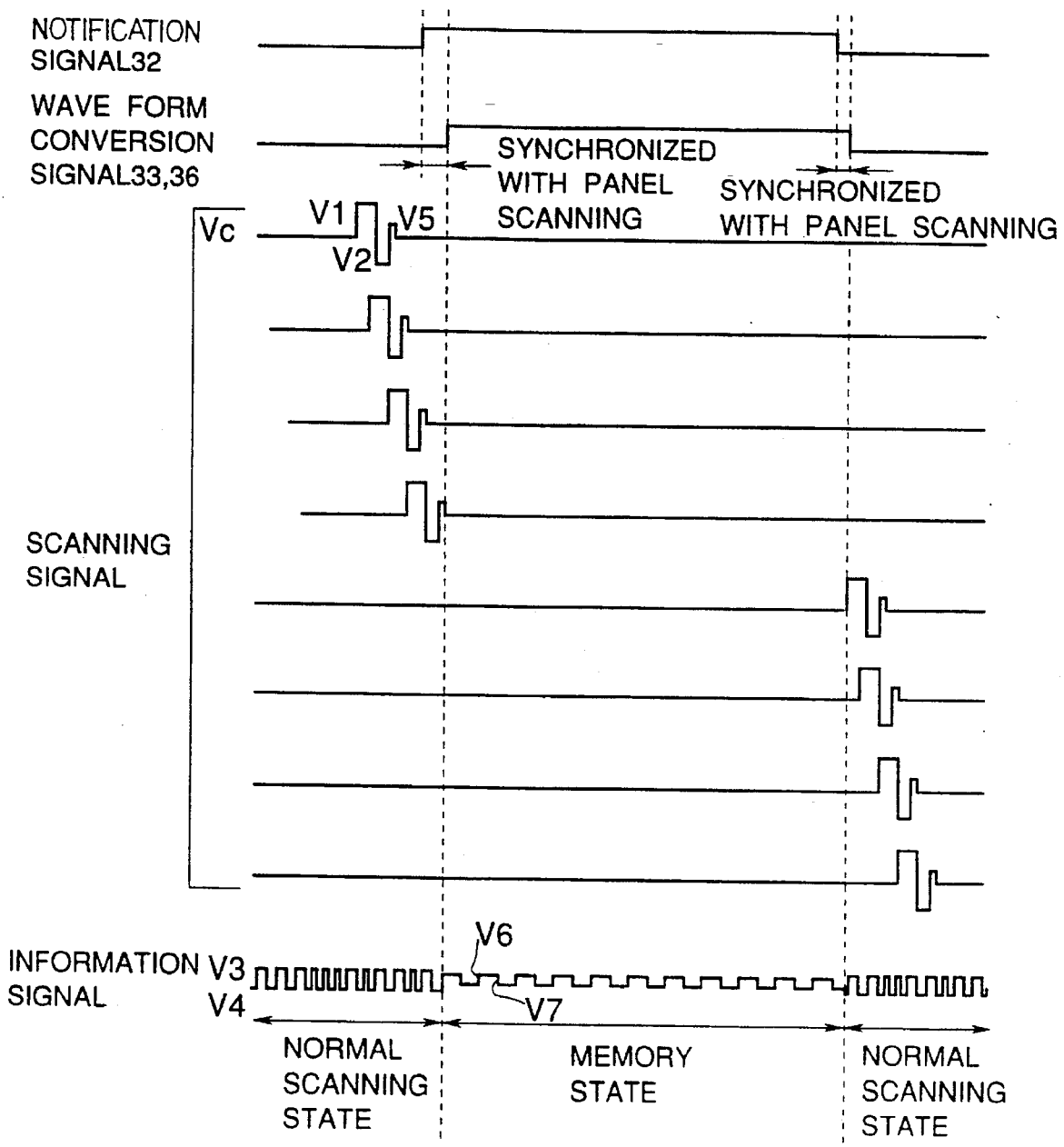
FIG. 5 is a timing chart when a display panel is controlled to a memory state in the apparatus of FIG. 3.

FIG. 4 shows scanning signals (driving waveforms) which are applied to the group of scanning electrodes and information signals (driving waveforms) which are applied to the group of information electrodes when the display panel 18 is shifted to the memory state and is returned to the ordinary driving state. FIG. 5 shows a timing chart of the waveforms shown in FIG. 4. (a) in FIG. 4 shows the scanning electrode driving waveform which is output from the common driver 17. (b) in FIG. 4 shows an information electrode driving waveform which is output from the segment driver 15. After all of the pixels on one scanning line were once erased by an erasing pulse (voltage level: V1) on the positive electric field side, the scanning electrode driving waveform shown in (a) in FIG. 4 is written by a writing-in pulse (voltage level: V2) on the negative electric field side. The writing-in pulse is synchronized with the information electrode driving waveform (voltage level: V3, V4) shown in (b) in FIG. 4. When the synthesized waveform of them exceeds a writing-in threshold value, the pixel is shifted from the erasing state to another state. When the synthesized waveform doesn't exceed the threshold value, the erasing state is held. In this manner, two light and dark states are separately written in the selection period (horizontal scanning period) as mentioned above and such an operation is repeated for all of the scanning lines, thereby obtaining a desired display. After the scanning driving output was stopped, since the apparatus generally enters the memory state, as for the output waveforms of the common and segment drivers, the Vc level is applied to the scanning electrode and the continuous pulse of both polarities (voltage level: V6, V7) is applied to the information electrode as shown in (c) and (d) in FIG. 4 respectively, thereby holding the luminance of the display panel.

When entering into the memory state, in order to reduce an electric power consumption while keeping luminance and contrast which are almost equal to those in the ordinary scanning mode, it is desirable that the relation between the waveforms shown in FIGS. 4(*b*) and 4(*d*) satisfies the following equation.

$$V3\times\Delta T\cong V6\times\Delta T1 \quad V4\times\Delta T\cong V7\times\Delta T2 \quad V3>V6 \quad V4>V7$$

However, in the case where the response time of the liquid crystal is slow as in case of driving at a low voltage or at a low temperature, more preferable luminance and contrast can be held by the following method.

$$V3\times\Delta T<V6\times\Delta T1 \quad V4\times\Delta T<V7\times\Delta T2 \quad V3>V6 \quad V4>V7$$

In this instance, the electric power consumption is $$\frac{2\Delta T\,(V6-V7)^2}{(\Delta T1+\Delta T2)\,(V3-V4)^2}$$

times as large as that in the ordinary scanning mode.

Since the voltage levels V6 and V7 can be easily supplied by changing the resistance dividing ratio in the power source which have conventionally supplied the voltage levels V1 to V5, a rectangular wave can be used as a driving waveform when shifting to the memory state in the embodiment. In place of the rectangular wave, a sine wave or the like can be also used as such a driving waveform. In this instance, another power source (AC power source) is prepared and it is sufficient to adjust the amplitude so as not to cause a flickering.

Figure 6:
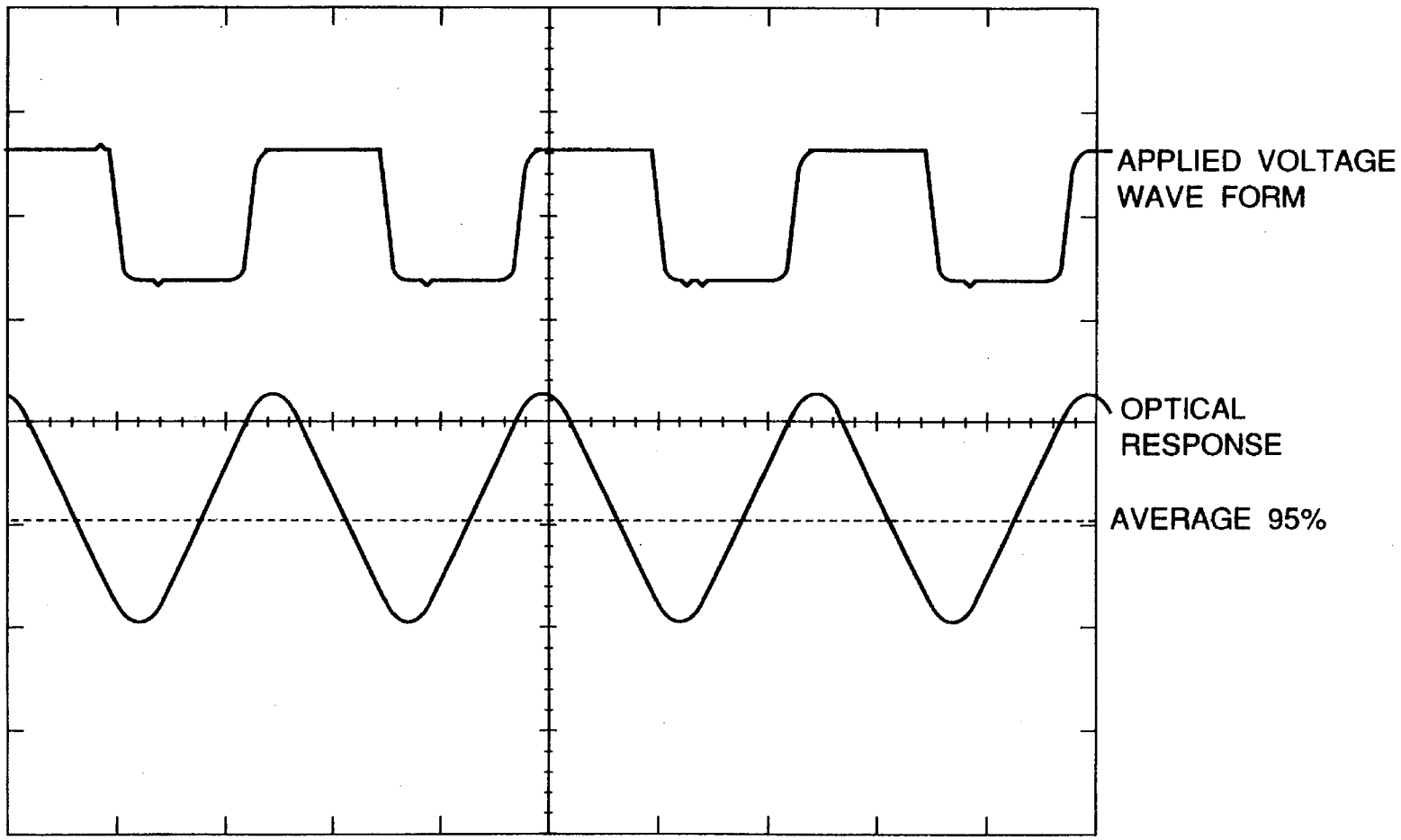
FIG. 6 is a diagram showing an optical response when the display panel in FIG. 3 is set into a light state and the waveform of (b) in FIG. 4 was applied.
Figure 7:
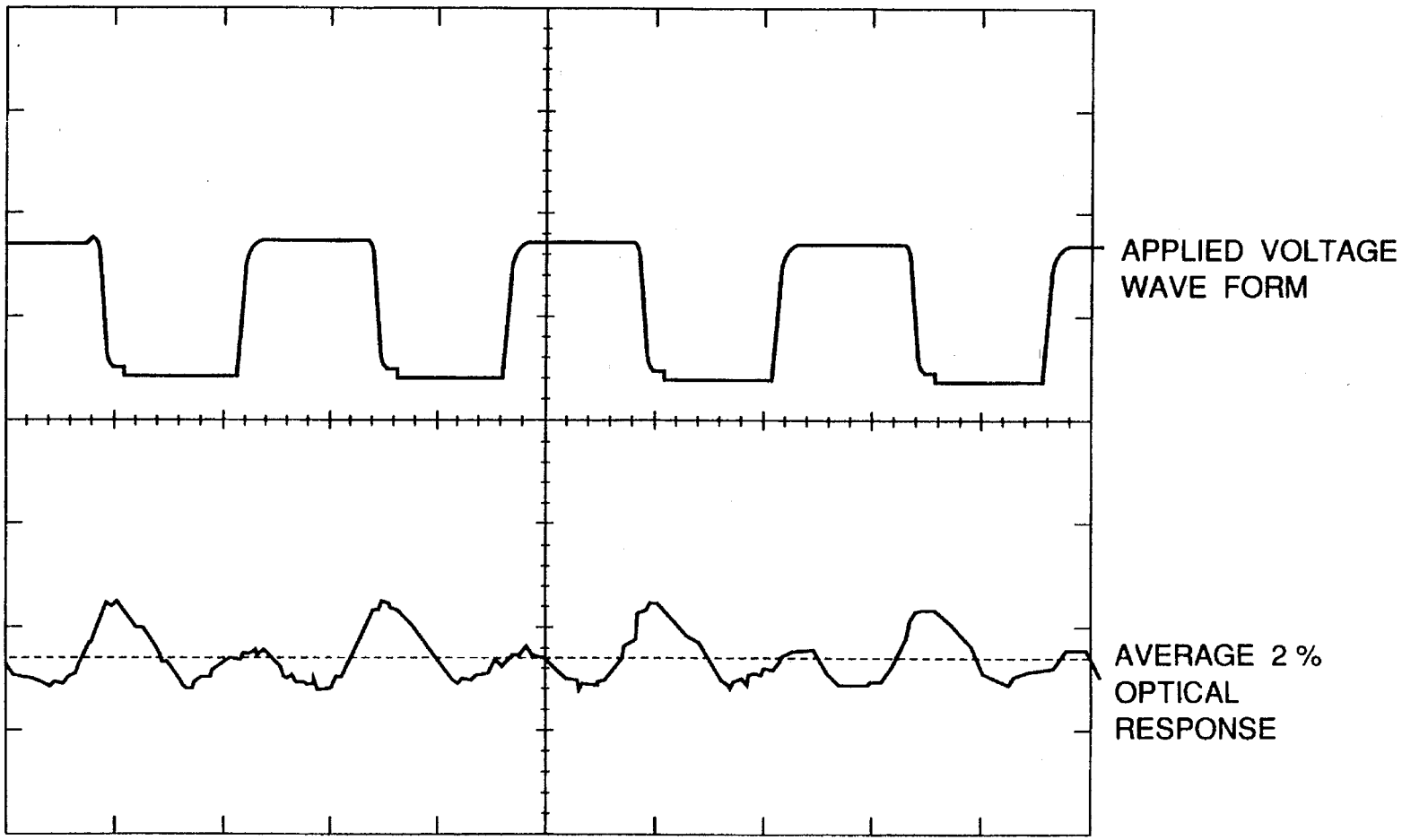
FIG. 7 is a diagram showing an optical response when the display panel in FIG. 3 is set into a dark state and the waveform of (b) in FIG. 4 was applied.
Figure 8:
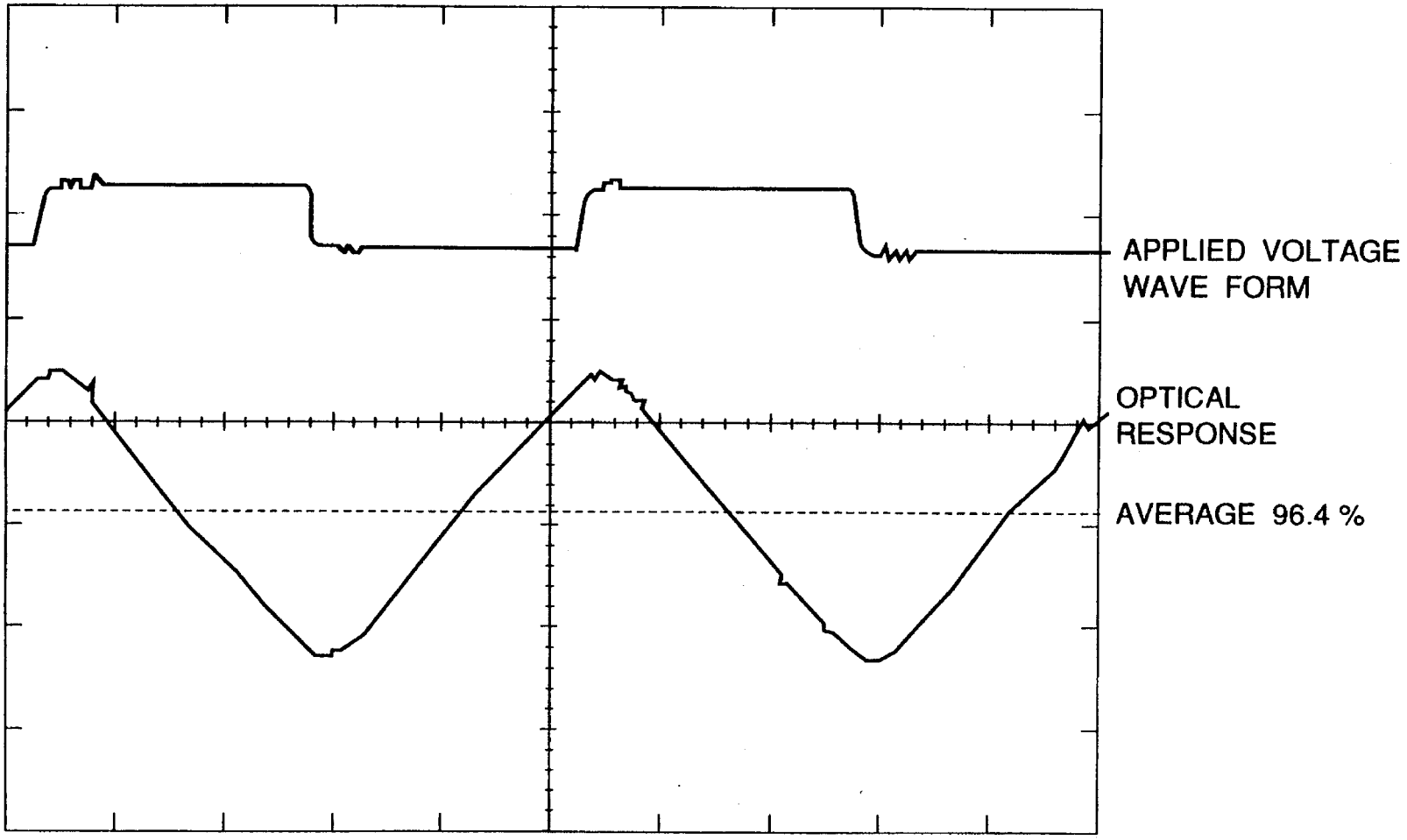
FIG. 8 is a diagram showing an optical response when the display panel in FIG. 3 is set into a light state and the waveform of (d) in FIG. 4 was applied.
Figure 9:
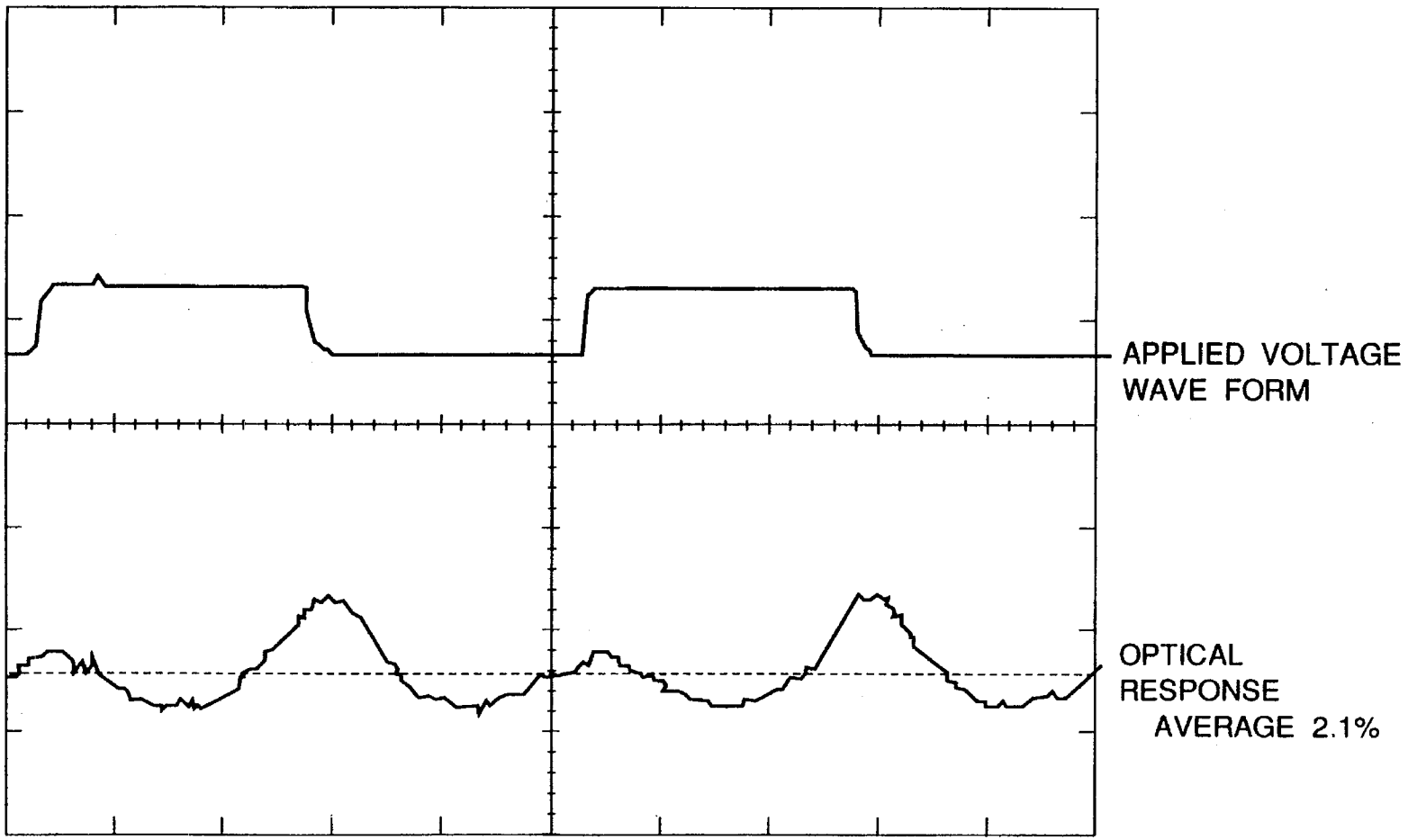
FIG. 9 is a diagram showing an optical response when the display panel in FIG. 3 is set into a dark state and the waveform of (d) in FIG. 4 was applied.

FIGS. 6 and 7 show voltages which are applied to the non-selection pixel and their optical responses in the light and dark states in the ordinary scanning mode in the embodiment, respectively. FIGS. 8 and 9 show voltages which are applied to the pixel and their optical responses in the light and dark states in the memory display mode in the embodiment, respectively. In this instance, in the waveforms of FIG. 4, V1=14 V, V2=−14 V, V3=6 V, V4=−6 V, V5=6.6 V, V6=3 V, V7=−3 V, Vc=0 V, ΔT=25 μsec, ΔT1=50 μsec, and ΔT2=50 μsec. Measuring ranges in the light state and dark state are set to different values.

Figure 10:
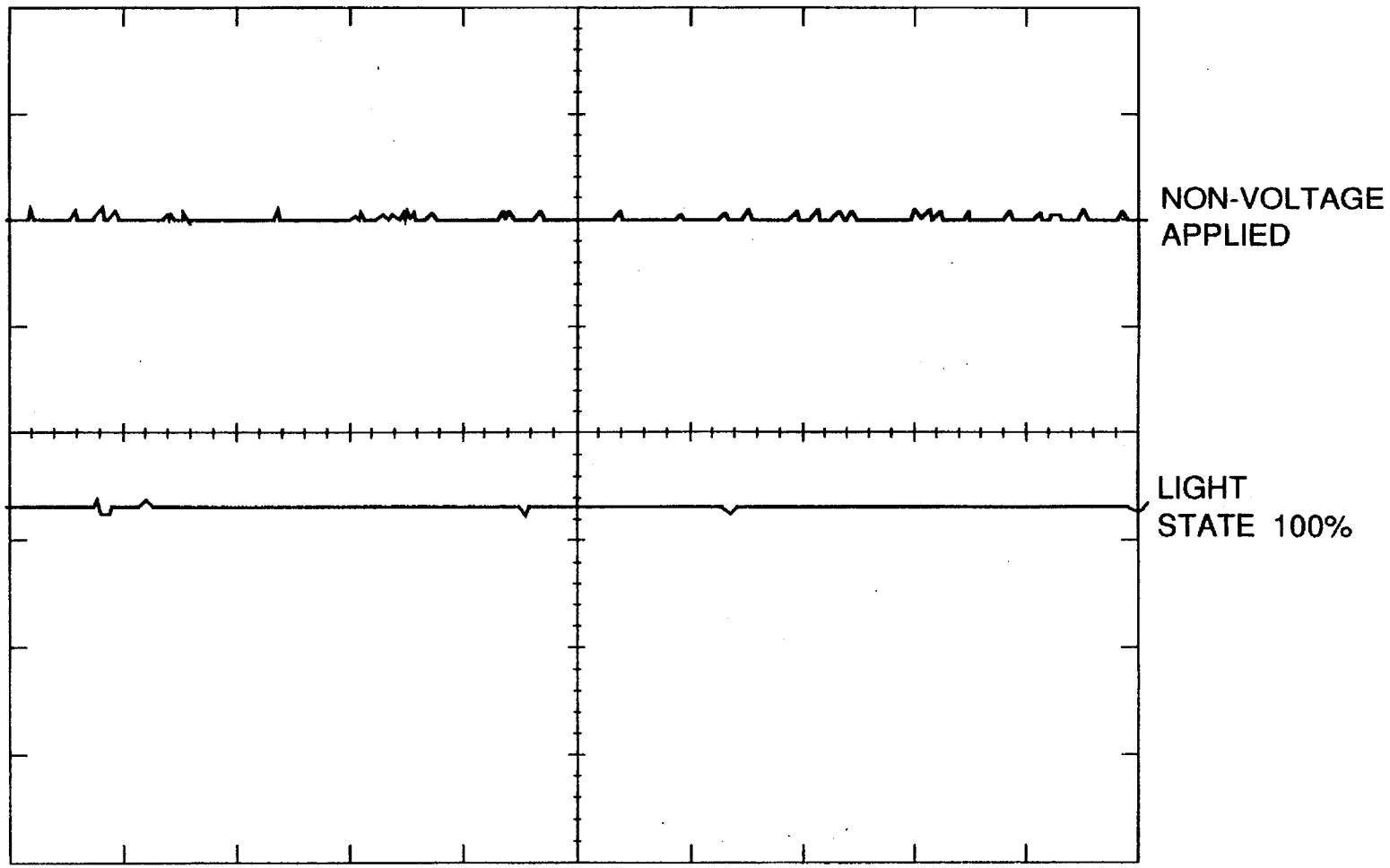
FIG. 10 is a diagram showing an optical response when the display panel in FIG. 3 is set into a light state and no voltage is applied.
Figure 11:
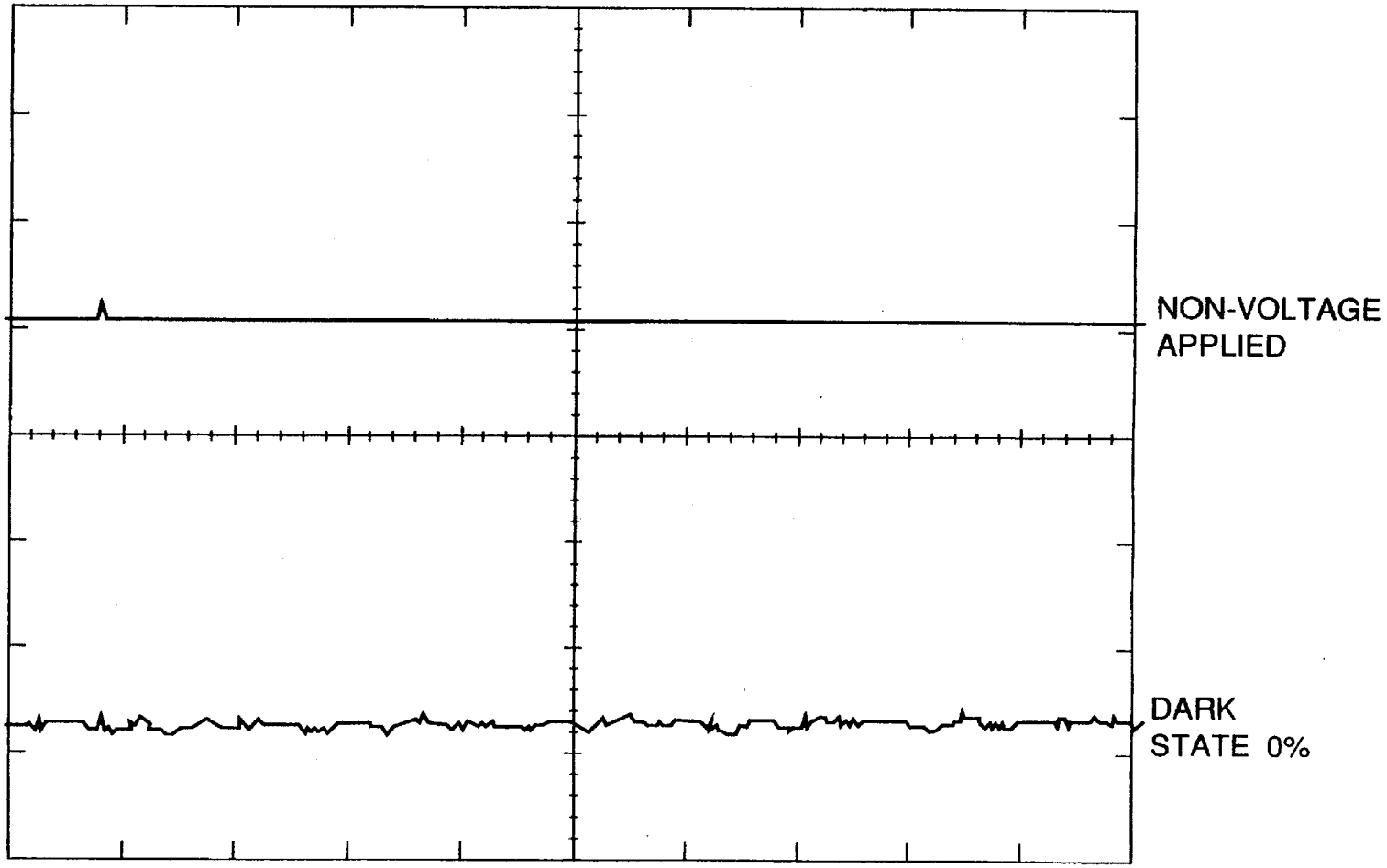
FIG. 11 is a diagram showing an optical response when the display panel in FIG. 3 is set into a dark state and no voltage is applied.

FIGS. 10 and 11 show voltages and optical responses in the light and dark states when no voltage is applied (in the conventional memory display mode), respectively. An average luminance was calculated on the assumption that the luminance in the dark state when no voltage is applied is set to 0% and the luminance in the light state is set to 100%. Table 1 shows the results of the calculations.

TABLE 1

| | Ordinary scanning | Memory display mode (embodiment) | No voltage is applied (prior art) |
|---|---|---|---|
| Light state | 95.0% | 96.4% | 100.0% |

TABLE 1-continued

| | Ordinary scanning | Memory display mode (embodiment) | No voltage is applied (prior art) |
|---|---|---|---|
| Dark state | 2.1% | 2.0% | 0.0% |

According to the measurements by the present inventors et al., it has been confirmed that in the FLC display unit used in the embodiment, a difference of the luminance in which the operator perceives a flickering largely differs in dependence on the display state and the ambient brightness. It has been found out that when the ambient brightness is equal to about 500 luxes, the operator perceives a flickering when there is a luminance difference of about 5% or more in case of the light display state and when there is a luminance difference of about 0.5% or more in case of the dark display state.

Hitherto, a flickering has occurred when switching from the ordinary scanning mode to the memory display mode in the dark state. In the embodiment, however, the luminance difference is equal to 1.6% in the light state and to 0.1% in the dark state, so that a luminance difference, namely, a flickering substantially doesn't occur.

The liquid crystal used in the embodiment includes a pyrimidine component which shows ferroelectricity in the chiral smectic phase and has the characteristics shown in the following table 2.

TABLE 2

| | | |
|---|---|---|
| $P_s$ | 6.nC/cm$^2$ | (30° C.) |
| Tilt angle | 14.6° | (30° C.) |
| $\Delta\epsilon$ | −0.2 | (30° C.) |

$$\text{Iso} \underset{91.8^\circ\text{ C.}}{\overset{91.5^\circ\text{ C.}}{\rightleftarrows}} \text{Ch} \underset{85.7^\circ\text{ C.}}{\overset{85.0^\circ\text{ C.}}{\rightleftarrows}} \text{SmA} \overset{66.7^\circ\text{ C.}}{\rightleftarrows} \text{SmC*} \underset{-12.5^\circ\text{ C.}}{\overset{-16.7^\circ\text{ C.}}{\rightleftarrows}} \text{Cryst}$$

As mentioned above, it is desirable that the ratio between the luminance in the scanning non-selection period of time by the first driving means and the luminance by the second driving means lies within a range from 0.95 to 1.05 and, further, the liquid crystal is a ferroelectric liquid crystal.

According to the embodiment as described above, since the apparatus comprises the means for detecting a change in image information and the means for holding the display contents and switching the driving means in accordance with the result of the detection, in the case where there is no change in the image information for a predetermined time or more or the like, the display screen can be held, the electric power consumption can be reduced, and the reliability of the apparatus can be improved.

EMBODIMENT 2

In the embodiment, generally, the image display (ordinary display) according to the image information which changes momentarily is executed by the partial rewriting scanning, whole screen refresh scanning by the multi-interlace, or the like. However, in the case where it is determined from the detection result by the change detecting means that the image information is not changed for a predetermined period of time or the like, the driving control means allows the memory display to be executed after the elapse of a predetermined switching period of time. After that, in the case where the change detecting means detects the change in image information or the like, the driving control means allows the applying operation of the scanning signal and information signal to be restarted after the elapse of a predetermined switching period of time, so that the ordinary display is again performed. When switching from the ordinary display mode to the memory display mode, the vibration of the liquid crystal molecule by the driving waveform is gradually suppressed within the above switching period of time. When switching from the memory display mode to the ordinary display mode, the liquid crystal molecule is gradually vibrated. Due to this, the same image display period of time which becomes a cause of the deterioration of the picture quality is reduced, the deterioration of the picture quality is prevented, and the reliability of the apparatus is raised. The electric power consumption can be further reduced without causing a flicking upon switching of the driving means.

A construction of the display apparatus according to the embodiment 2 of the invention is the same as that of the block diagram shown in FIG. 3.

The processes in case of updating the display screen are substantially the same as those in the embodiment 1.

The case where the host CPU doesn't update the display screen for a predetermined time or more will now be described. In this case, the driving signal to the panel 18 is changed in a manner such that the FLC display panel is set into the memory state without causing a flicking of the display on the display screen by the notification signal 32 from the access sampling counter 7.

The access sampling counter 7 is a counter for setting the access (writing-in) signal to the video memory 9 to the reset (or preset) signal and setting the sync signal 31 (for example, horizontal sync signal) from the FLC display unit 50 to a clock. The overflow (carry) signal of the counter is set to the notification signal 32 indicating that there is no access to the video memory 9 for a predetermined time or more. Actually, one frame time (for example, horizontal sync signal ×1024 in the case were the number of scanning lines is equal to 1024) is counted from the sync signal 31 (horizontal sync signal) and the signal which is obtained by frequency dividing the one frame time into 164 is input as a clock to the 8-bit counter (access sampling counter). Now, assuming that the standard horizontal scanning time of the FLC display panel is equal to 100 μsec, the detecting time can be set to a value within a range from about six seconds to about 27 minutes in accordance with the preset value of the counter. When the video memory 9 is not accessed for such a set detecting time, the access sampling counter 7 asserts the notification signal 32 (sets into an enable state), thereby informing the display controller 12 of the fact that the access to the video memory 9 has been stopped (there is no change in the screen display). The notification signal 32 is output asynchronously with the driving of the display panel 18.

When it is recognized that the notification signal 32 was asserted, the display controller 12 waits for the end of driving of the scanning electrode which is at present being scanned (because the notification signal 32 is asynchronously received) and sends the memory display signal (included in the signals 33 and 36) to both of the segment and common drivers. After that, the output (scanning signal) of the common driver 17 is held at the level of VC shown in (b) in FIG. 12 for a period of time until the start of the switching operation to the ordinary driving mode. On the other hand, all of the bits of the segment driver 15 output a waveform shown in (d) in FIG. 12. The display controller 12, further, sets the output (information signal of (d) in FIG. 12 of the segment driver 15 by changing the voltage V6 from V3 to VC and the voltage V7 from V4 to VC for a predetermined switching period of time and sets such an output signal to VC after completion of the switching period of time. FIG. 13 shows such a state.

Figure 14:
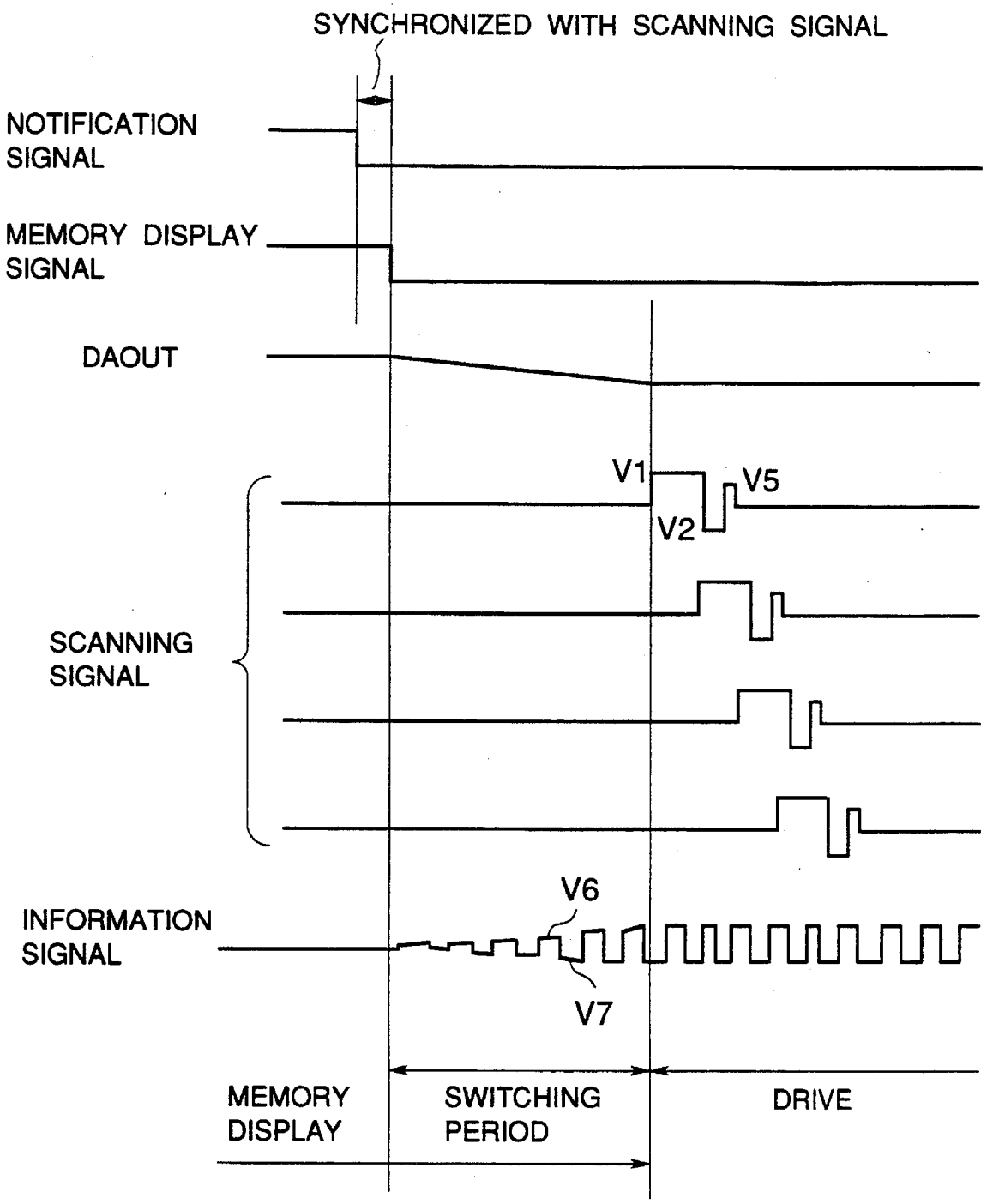
FIG. 14 is another timing chart when the display state is switched from the memory display mode to the normal display mode in the apparatus of FIG. 3.

The operation when returning from the memory display state to the ordinary driving (ordinary display) state will now be described. When the video memory 9 is accessed even once, the access sampling counter 7 immediately negates the notification signal 32 (sets into a disable state), thereby informing the display controller 12 of the fact that there is an access (writing-in request) to the video memory 9. Since the notification signal 32 is output asynchronously with the driving (scanning) of the display panel in a manner similar to that in the asserting case, the display controller 12 waits for the end of the driving of the scanning electrode which is at present being scanned (synchronously with the scanning of the display panel) and negates the driving waveform changing signals 33 and 36 to both of the segment and common drivers. The voltage V6 is changed from VC to V3 and the voltage V7 from VC to V4 in (d) in FIG. 12 for a predetermined switching period. After completion of the switching time, the ordinary driving waveforms are generated from the common driver 17 and segment driver 15, thereby returning to the ordinary driving state, namely, the above "partial rewriting scanning+whole screen refresh scanning" state. FIG. 14 shows such a situation.

Figure 12:
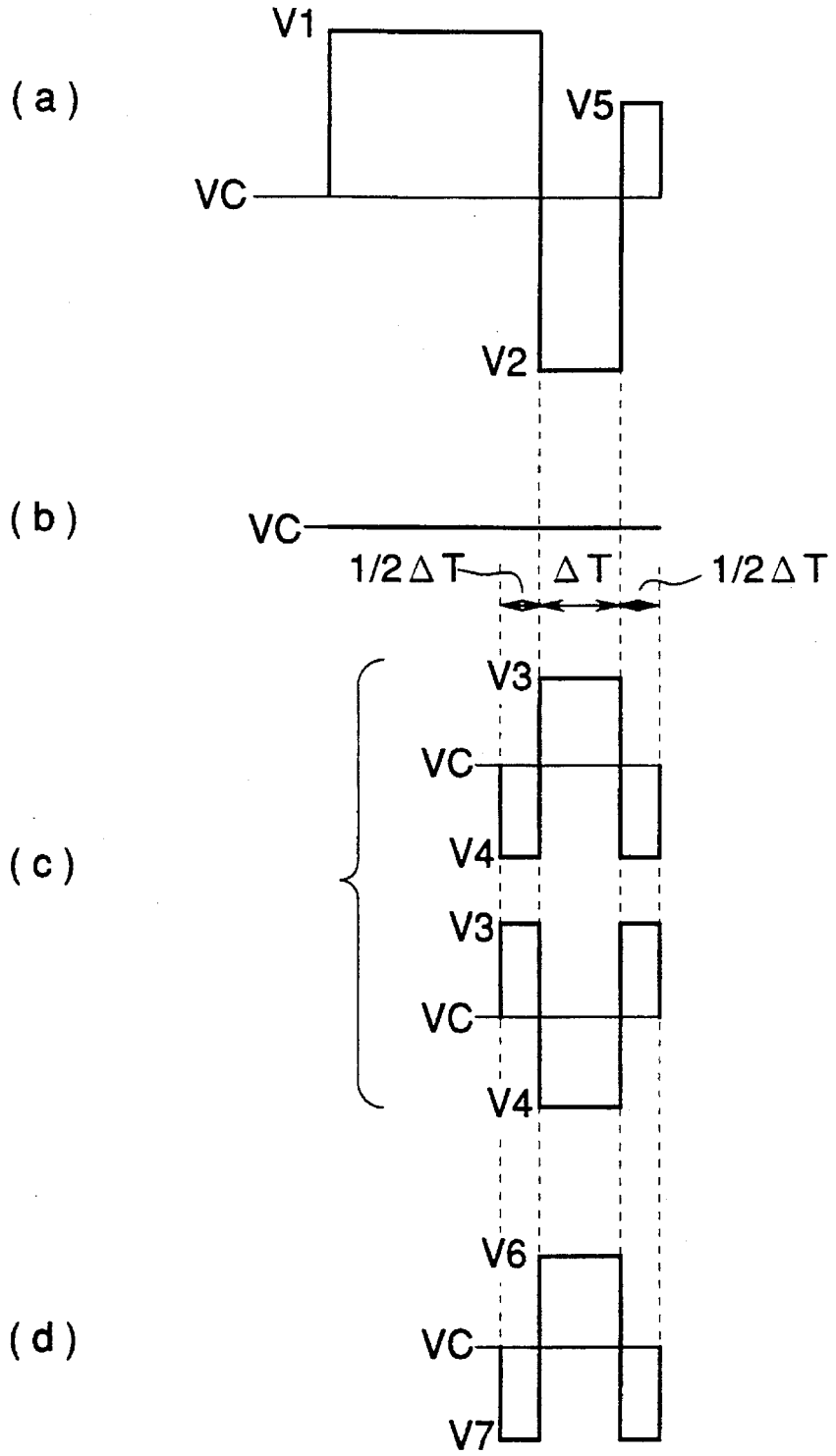
FIG. 12 is a diagram showing other driving waveforms used in the apparatus of FIG. 3.
Figure 13:
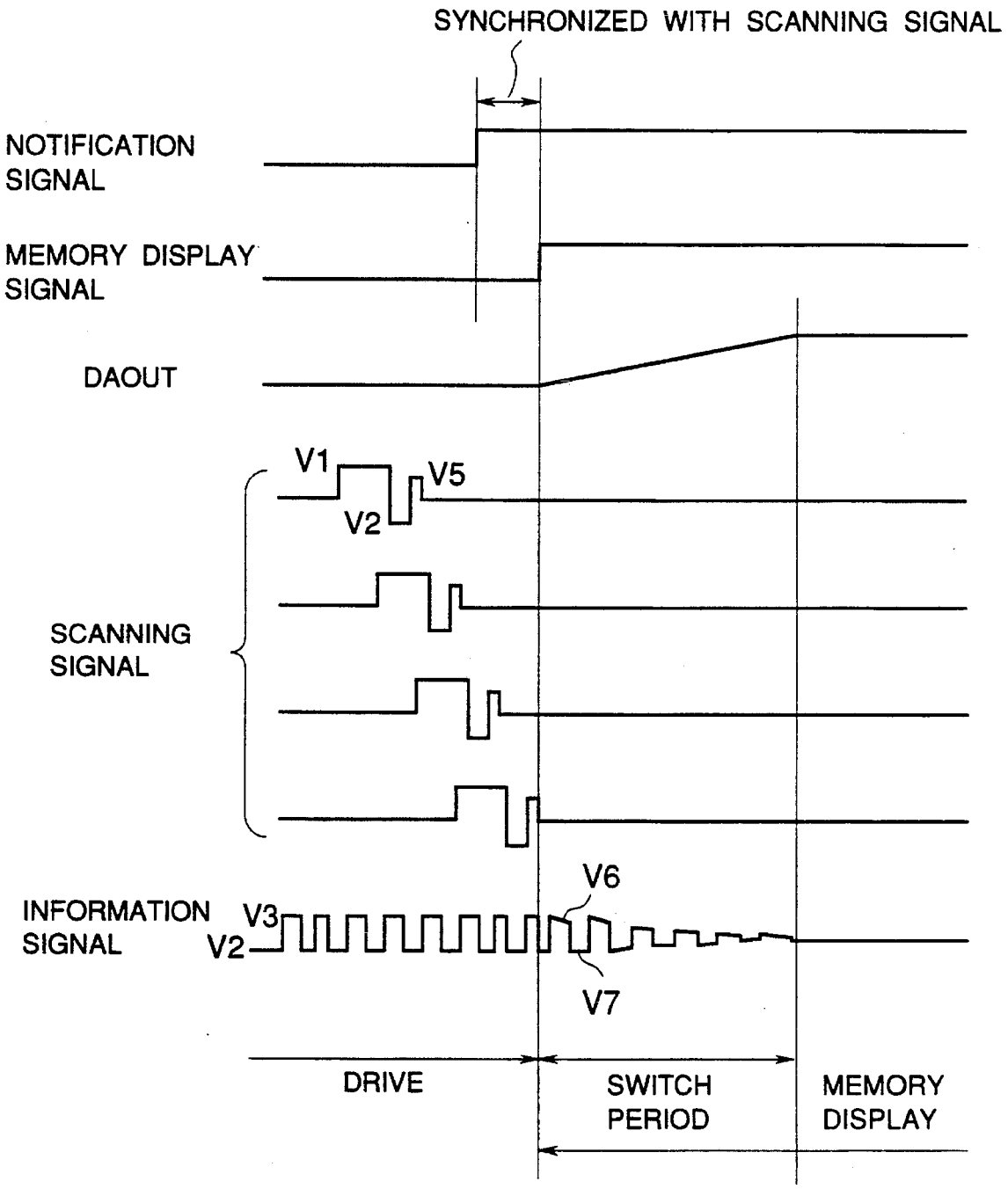
FIG. 13 is another timing chart when the display state is switched from a normal display mode to a memory display mode in the apparatus of FIG. 3.

(a) to (c) in FIG. 12 show driving waveforms which are applied to the electrodes in the ordinary driving mode. (d) in FIG. 12 shows a scanning non-selection waveform. (c) in FIG. 12 shows an information waveform which is output from the segment driver 15. As for the scanning selection waveform shown in (a) in FIG. 12, after all of the lines (one scanning line) were once erased by an erasing pulse (voltage level: V1) on the positive electric field side, the waveform is written by a writing-in pulse (voltage level: V2) on the negative electric field side. The writing-in pulse is synchronized with an information waveform (voltage level: V3, V4) shown in (c) in FIG. 12. When the synthesized waveform of those waveforms exceeds a writing-in threshold value, the apparatus is shifted from the erasing state to another state. When the synthesized waveform doesn't exceed the threshold value, an erasing state is held. By separately writing two light and dark states within the selection period of time (horizontal scanning period) and repeating such processes for all of the scanning lines, a desired display is obtained. The scanning non-selection waveform is held to the VC level.

(d) in FIG. 12 shows an output waveform which is applied from the segment driver 15 for the switching period of time. The common driver 17 outputs the signal at the same VC level as that of the scanning non-selection waveform in (b) in FIG. 12 for the switching period of time and the memory display period of time. As mentioned above, for the switching period of time, the voltages V6 and V7 change and a degree of the vibration of the liquid crystal molecule is changed, thereby eliminating or reducing the flickering which occurs upon switching between the ordinary driving mode and the memory display mode.

FIG. 13 is a timing chart when switching from the ordinary driving mode to the memory display mode. FIG. 14 is a timing chart when switching from the memory display mode to the ordinary driving mode.

Figure 15A:
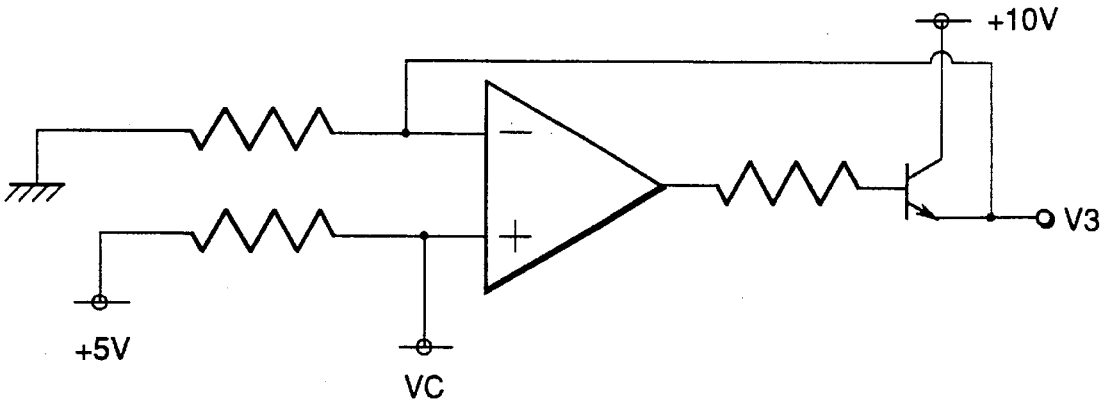
FIGS. 15A and 15B are circuit diagrams as an example of a power supply circuit which is used in the apparatus of FIG. 3.
Figure 15B:
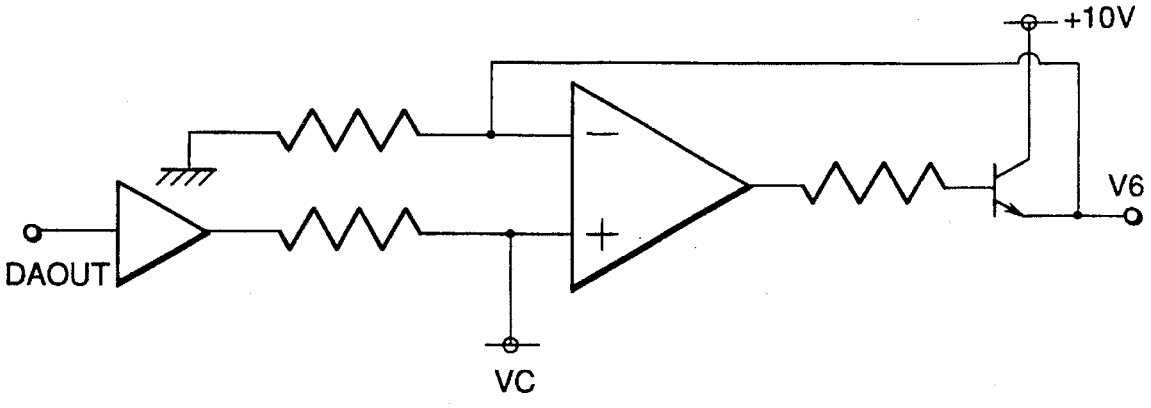

FIG. 15A shows an example of a power source circuit which is generally used in the apparatus of FIG. 3. FIG. 15B shows a circuit for changing the voltage level V6 to a potential between the V3 level and the VC level. In place of the input voltage of +5 V of the output circuit at the V3 (for example, +5 V) level shown in FIG. 15A, a signal which is obtained by inverting an output DAOUT of a D/A converter (not shown) is input. The DAOUT denotes the signal which rises or falls at a timing with a time delay from the memory display signal. When the potential of DAOUT changes, the voltage of V6 also changes. The voltage level V7 also changes to a potential between V4 and VC in a manner similar to the case of V6.

In the waveforms shown in FIG. 12, V1=14 V, V2=−14 V, V3=6 V, V4=−6 V, V5=6.6 V, VC=0 V, and $\Delta T$=25 μsec. The luminances in the ordinary driving mode and the memory display mode were measured, so that the results shown in the following table 3 were obtained. (In the table 3, the measurement values were standardized by setting the luminance in the dark state in the memory display mode to 0% and the luminance in the light state to 100%.)

TABLE 3

| | Ordinary driving mode | Memory display mode |
|---|---|---|
| Light state | 95.0% | 100.0% |
| Dark state | 2.1% | 0.0% |

According to the measurements by the inventors, it has been confirmed that in the FLC display unit used in the embodiment, a difference of the luminance in which the operator perceives a flickering largely differs in accordance with the display state and the ambient brightness. It has been found out that, when the ambient brightness is equal to about 500 luxes, the operator perceives a flickering in the case where there is a luminance difference of about 5% or more in case of the light display state and where there is a luminance difference of about 0.5% or more in the dark state. Therefore, when the ordinary driving is performed under the above conditions and the driving is suddenly stopped, namely, when the display mode is switched to the memory display mode without a switching period of time, a flickering occurs in the dark display portion.

However, when the switching period of time is set to 20 msec and the voltages of V6 and V7 are gradually changed according to the invention, a flickering in the dark display portion doesn't occur. When switching from the memory display mode to the ordinary driving mode, by providing the switching period of time of 20 msec, no flickering occurs.

The ferroelectric liquid crystal used in the embodiment is the same as that mentioned above.

Figure 16:
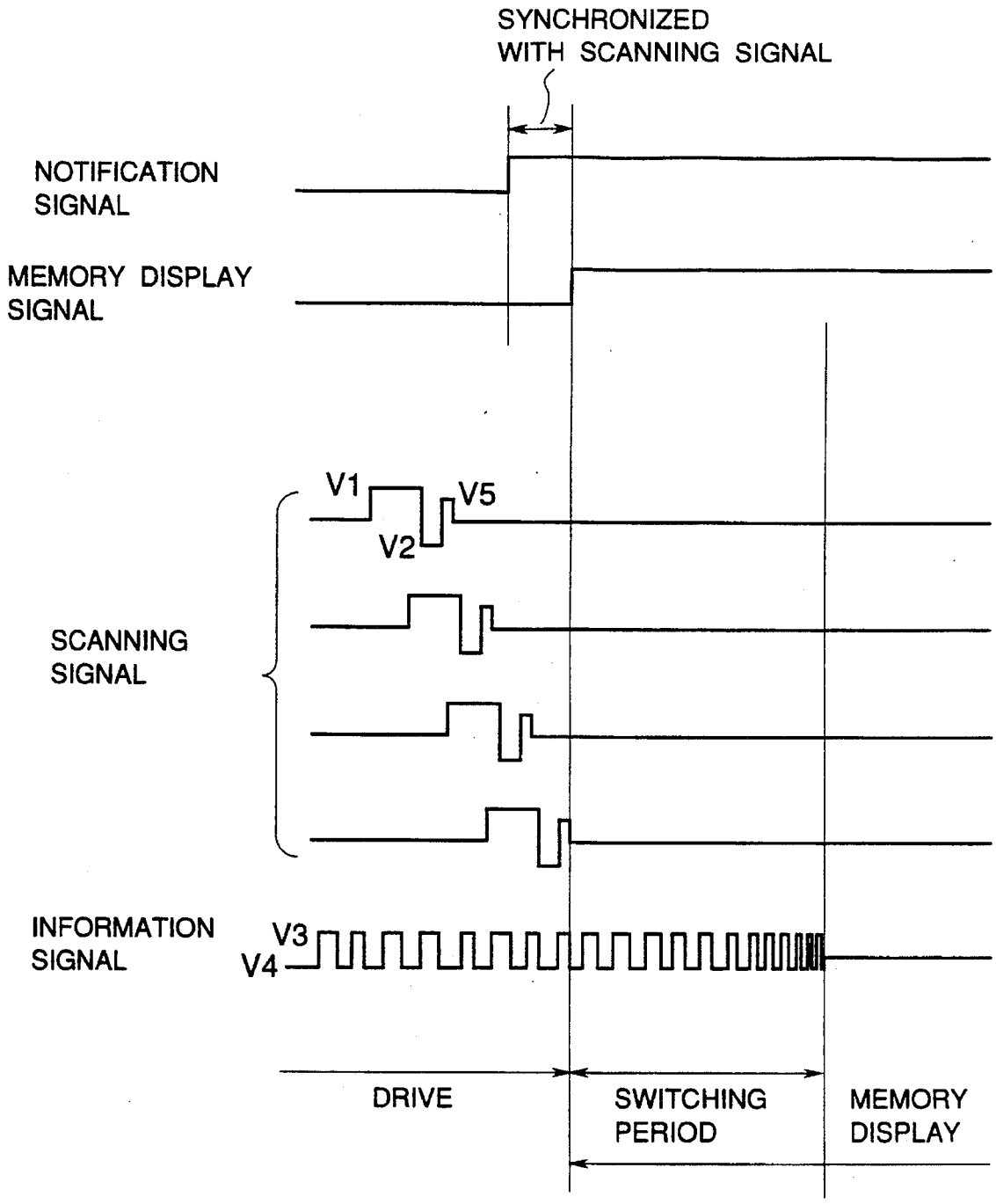
FIG. 16 is a timing chart when the display state is switched from the normal display mode to the memory display mode in the embodiment 3.

FIG. 16 shows a timing chart when switching from the ordinary driving mode to the memory display mode in the display apparatus according to the embodiment 3 of the present invention. Although the voltages of V6 and V7 are gradually changed in the switching period of time in the embodiment 2, according to the embodiment 3, the voltages V6 and V7 are held constant at V3 and V4, respectively, but the pulse widths of those voltages are gradually changed in place of them. At the same time, the frequencies also gradually rise. A construction of the embodiment 3 is substantially the same as that of the embodiment 2 except that the voltage circuit to generate the voltages V6 and V7 is omitted.

In the embodiment, when it is recognized that the notification signal 32 was asserted, the display controller 12 waits for the end of the driving of the scanning electrode which is at present being scanned and sends the memory display signal to both of the segment and common drivers. After that, the output of the common driver 17 is held at the VC level for a period of time until the start of the switching operation to the ordinary driving state. On the other hand, the segment driver 15 outputs the waveform shown in (c) in FIG. 12. In this instance, by gradually reducing the width of ΔT for the switching period of time, the degree of vibration of the liquid crystal molecule is changed. When the width of ΔT is equal to 5 μsec, the output of the segment driver 15 is also set to the VC level, thereby performing the memory display.

Figure 17:
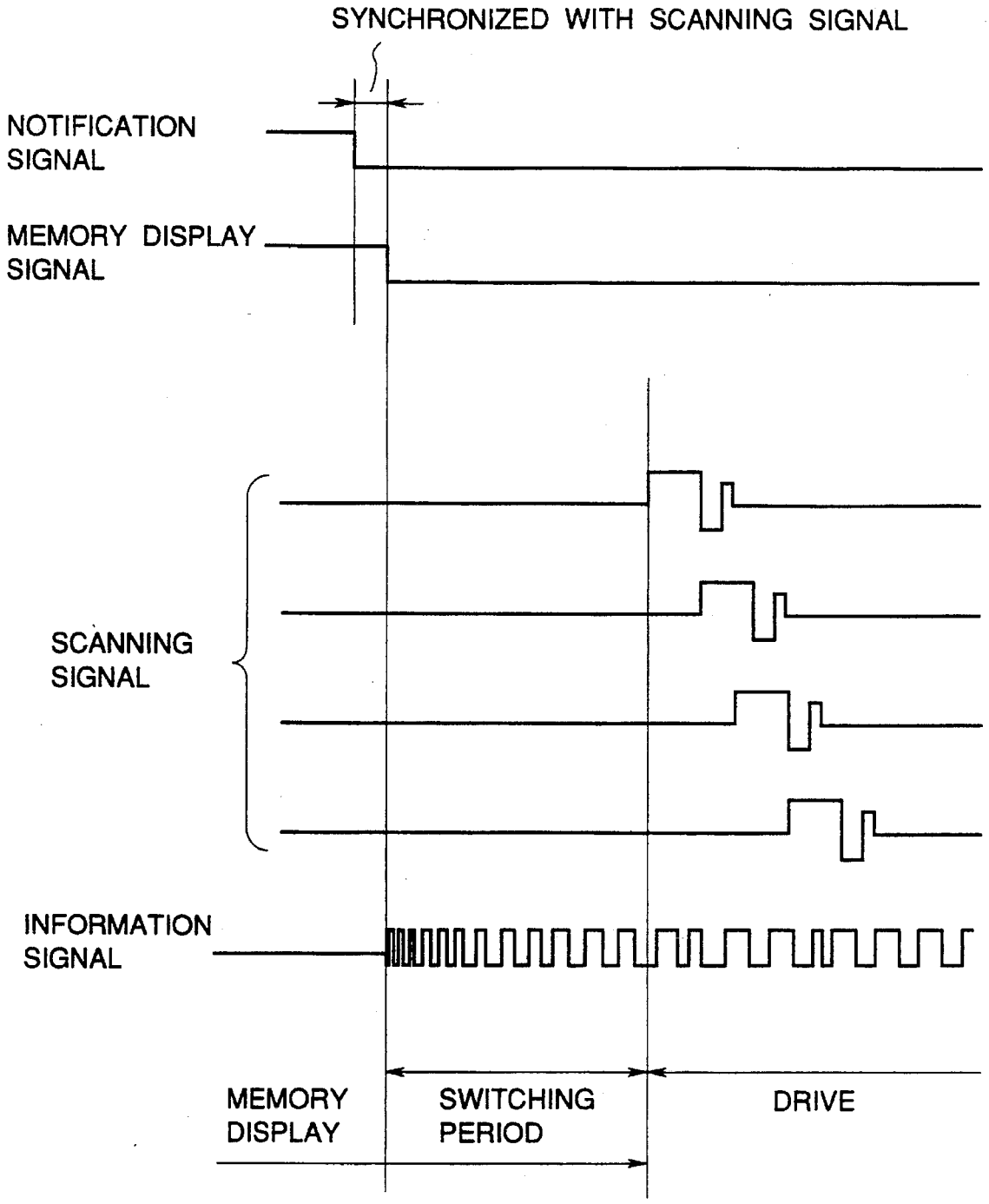
FIG. 17 is a timing chart when the display state is switched from the memory display mode to the normal display mode in the embodiment 3.

When switching from the memory display mode to the ordinary driving mode, the width of ΔT is gradually increased from 5 μsec for the switching period of time. When it is equal to the same width as that in the ordinary driving mode, the scanning signal is output from the common driver 17 at a proper timing. FIG. 17 shows such a situation.

The ordinary driving waveform is also generated from the segment driver 15, thereby returning to the ordinary driving mode, namely, the above "partial rewriting scanning+whole screen refresh scanning" state. FIG. 14 shows such a situation.

Even in case of changing the width of ΔT, no flickering occurs in a manner similar to the case of the embodiment 2.

According to the embodiment as mentioned above, the apparatus comprises the means for detecting a change in image information and switching means for holding the display contents in accordance with the detection result and for switching the display mode to the ordinary driving display mode or the memory display mode, wherein upon switching of the display mode, the switching period of time is provided and the driving signal is gradually changed. Therefore, in the case where there is no change in image information for a predetermined time or more or the like, the display screen can be held without causing a flickering, the electric power consumption can be reduced, and the reliability of the apparatus can be improved.

As described above, according to the invention, the differences of the contrasts and luminances in the ordinary refresh scanning mode and the non-refresh scanning mode using the memory effect are small and a good display quality is obtained.

What is claimed is:

1. A driving method on a display device, said method comprising:

a first step of presenting a display by refresh scanning, on the basis of image information, on a liquid crystal display device which has a liquid crystal and scanning and information electrodes arranged in a matrix form and in which a plurality of pixels having a memory effect are provided; and a second step of presenting a display by non-refresh scanning without substantially changing the image information, wherein a non-zero voltage signal to fluctuate a transmission light amount of the plurality of pixels is applied to the information electrodes during said second step, and wherein in the first step a scanning selection signal is successively supplied to the scanning electrodes, and in the second step, the scanning selection signal is not supplied to the scanning electrodes.

2. An apparatus for driving a display device, comprising:

refresh scanning means for refresh scanning to present a display of image information on a liquid crystal display device which has a liquid crystal and scanning and information electrodes arranged in a matrix form and in which a plurality of pixels having a memory effect are provided; and non-refresh scanning means for non-refresh scanning to present a display without substantially changing the image information, wherein said non-refresh scanning means applies a signal to fluctuate a transmission light amount of the plurality of pixels to the information electrodes during the non-refresh scanning operation, wherein the refresh scanning means supplies a scanning selection signal successively to the scanning electrodes, and the non-refresh scanning means does not supply the scanning selection signal to the scanning electrodes.

3. An apparatus for driving and controlling a liquid crystal display apparatus, comprising:

display means which has a liquid crystal and scanning and information electrodes arranged in a matrix form and in which a plurality of pixels having a memory effect are provided;

scanning means for scanning the pixels to display image information on said display means; and selecting means for selecting either one of a refresh scanning mode for refresh scanning to display the image information on the liquid crystal display device and a non-refresh scanning mode for non-refresh scanning to display without substantially changing the image information, wherein, in the non-refresh scanning mode, said scanning means is controlled so as to supply a signal to fluctuate a transmission light amount of the plurality of pixels from said scanning means to said information electrodes, wherein in the refresh scanning mode a scanning selection signal is successively supplied to the scanning electrodes, and in the non-refresh scanning mode the scanning selection signal is not supplied to the scanning electrodes.

4. An apparatus for displaying, comprising:

liquid crystal display means which has a liquid crystal and scanning and information electrodes arranged in a matrix form and in which a plurality of pixels having a memory effect are provided;

scanning means for scanning said liquid crystal display means to display image information; and selecting means for selecting either one of a refresh scanning mode for refresh scanning to display the image information and a non-refresh scanning mode for non-refresh scanning to display without substantially changing the image information displayed in said liquid crystal display means, wherein in said non-refresh scanning mode, said scanning means is controlled so as to supply a signal to fluctuate a transmission light amount of the plurality of pixels from said scanning means to the information electrodes and wherein in the refresh scanning mode a scanning selection signal is successively supplied to the scanning electrodes, and in the non-refresh scanning mode the scanning selection signal is not supplied to the scanning electrodes.

5. An apparatus according to any one of claims 2 to 4, wherein said liquid crystal is a smectic liquid crystal.

6. An apparatus according to any one of claims 2 to 4, wherein said liquid crystal is a ferroelectric liquid crystal.

7. An apparatus according to any one of claims 2 to 4, wherein each of said plurality of pixels has a transistor.

8. An apparatus according to any one of claims 2 to 4, wherein each of said plurality of pixels has a non-linear device.

9. An apparatus according to any one of claims 2 to 4, wherein an amplitude or pulse width of said signal to fluctuate said transmission amount is time-sequentially decreased.

10. An apparatus according to any one of claims 2 to 4, wherein said signal to fluctuate said transmission light amount is a signal whose amplitude or pulse width is time-sequentially decreased and, after a predetermined period of time, a different signal, whose amplitude or pulse width is time-sequentially increased, is applied to the information electrodes.

11. An apparatus according to any one of claims 2 to 4, wherein said signal to fluctuate said transmission light amount is a signal whose amplitude or pulse width is time-sequentially constant.

12. A driving method according to claim 1, wherein the signal to fluctuate the transmission light amount is an A.C. pulse signal.

13. A driving method according to claim 1, wherein said refresh scanning provides all scanning electrodes with a reference voltage, and provides all information electrodes with an A.C. pulse signal.

14. An apparatus according to any one of claims 2 to 4, wherein the signal to fluctuate the transmission light amount is an A.C. pulse signal.

15. An apparatus according to any one of claims 2 to 4, wherein said refresh scanning provides all scanning electrodes with a reference voltage, and provides all information electrodes with an A.C. pulse signal.

16. A display apparatus comprising:

a liquid crystal display panel in which pixels are constructed by a group of scanning electrodes and a group of information electrodes in a matrix form;

a liquid crystal which is arranged in said liquid crystal display panel and is driven by an electric field applied through said group of scanning electrodes and said group of information electrodes;

an image information storing circuit to store image information to be displayed by said liquid crystal display panel;

a change detection circuit to detect whether the image information stored in said image information storing circuit has changed;

first driving means for applying a scanning signal to said group of scanning electrodes and applying an information signal to said group of information electrodes on the basis of the image information stored in said image information storing circuit; and second driving means for applying a waveform which produces, on said liquid crystal, a luminance that is almost equal to a luminance produced in a scanning non-selection period by said first driving means to said liquid crystal display panel while maintaining the display state on said display panel by application of the electric field to the group of scanning electrodes and the group of information electrodes in accordance with the result of the detection by said change detection circuit.

17. An apparatus according to claim 16, wherein a ratio between the luminance in said scanning non-selection period of time by said first driving means and the luminance by said second driving means lies within a range from 0.95 to 1.05.

18. An apparatus according to claim 16, wherein said liquid crystal is a ferroelectric liquid crystal.

19. A display apparatus comprising:

a liquid crystal display panel in which pixels are constructed by a group of scanning electrodes and a group of information electrodes in a matrix form, and a liquid crystal, said panel being driven by an electric field which is applied through the group of scanning electrodes and the group of information electrodes;

an image information storing circuit to store image information to be displayed by said liquid crystal display panel;

driving means for applying a scanning signal to the group of scanning electrodes and applying an information signal to the group of information electrodes on the basis of the image information stored in said image information storing circuit;

memory display means for holding display contents on the liquid crystal display panel without applying any voltage to the liquid crystal;

a change detection circuit to detect whether the image information stored in said image information storing circuit has changed; and a driving control circuit for switching a display mode of said liquid crystal between an ordinary display mode to be executed by said driving means and a memory display mode to be executed by said memory display means and for gradually changing a waveform that is applied to the liquid crystal after a predetermined switching period of time when said display mode is switched wherein, during a time period for gradually changing a waveform, the display contents is not changed.

20. An apparatus according to claim 19, wherein said driving control circuit changes an amplitude of a driving waveform in said switching period of time.

21. An apparatus according to claim 19, wherein said driving control circuit changes a pulse width of a driving waveform in said switching period of time.

22. An apparatus according to claim 19, wherein said liquid crystal is a ferroelectric liquid crystal.

23. A driving device of a display device with a memory effect, comprising:

means for performing one of first and second modes, wherein the first mode comprises successively applying a scanning selection signal to a scanning electrode of the display device and applying an information signal to an information electrode of the display device to perform an image display wherein the image can be rewritten, and the second mode comprises performing the image display using the memory effect without applying the scanning selection signal no the scanning electrode of the display device, wherein rewriting of the image is not performed; and means for switching the display device between the first and second modes, wherein, during the second mode, a non-zero voltage of a level which does not cause image rewriting is applied to the information electrode of the display device.

24. A driving device of a display device with a memory effect, comprising:

means for performing one of first, second and third modes, wherein the first mode comprises successively applying a scanning selection signal to a scanning electrode of the display device and applying an information signal to an information electrode of the display device to perform an image display wherein the image can be rewritten, the second mode comprises performing the image display using the memory effect without applying the scanning selection signal to the scanning electrode of the display device, wherein rewriting of the image is not performed, and the third mode comprises performing the image display using the memory effect without applying the scanning selection signal to the scanning electrode of the display device and without applying the information signal to the information electrode wherein the rewrite of the image is not performed; and means for switching the device between the first, second and third modes, wherein a non-zero voltage of a level which does not cause the image rewrite is applied to the information electrode of the display device during the second mode, and no voltage is applied at the intersection between the scanning electrode and the information electrode of the display device during the third mode, and wherein a mode change between the first and third modes are performed by performing the second mode between the first and third modes.

25. A device according to claim 23 or 24, wherein said display device includes a smectic liquid crystal.

26. A device according to claim 23 or 24, wherein said display device includes a ferroelectric liquid crystal.

* * * * *

UNITED STATES PATENT AND TRADEMARK OFFICE

CERTIFICATE OF CORRECTION

PATENT NO. : 5,583,534

DATED : December 10, 1996

INVENTOR(S) : KAZUNORI KATAKURA ET AL.

It is certified that error appears in the above-identified patent and that said Letters Patent is hereby corrected as shown below:

COLUMN 1
Line 67, delete "being".

COLUMN 2
Line 9, "Kamibe" should read --Kanbe--.
Line 15, delete "an".
Line 16, delete "a"
Line 24, "apply" should read --application--.

COLUMN 5
Line 34, "frame," should read --frame--.

COLUMN 6
Line 38, "An electric" should read --Electric--.

COLUMN 10
Line 33, "have" should read --has--.

COLUMN 12
Line 16, "flicking" should read --flickering--.
Line 27, "flicking" should read --flickering--.

COLUMN 13
Line 9, "signal" should read --signal)--.

UNITED STATES PATENT AND TRADEMARK OFFICE

CERTIFICATE OF CORRECTION

PATENT NO. : 5,583,534

DATED : December 10, 1996

INVENTOR(S) : KAZUNORI KATAKURA ET AL.

It is certified that error appears in the above-identified patent and that said Letters Patent is hereby corrected as shown below:

COLUMN 18

Line 59, "no" should read --to--.

Signed and Sealed this

Twenty-fourth Day of June, 1997

Bruce Lehman

*Attest:*

BRUCE LEHMAN

*Attesting Officer*

*Commissioner of Patents and Trademarks*